US005908723A

United States Patent [19]

Malhotra et al.

[11] Patent Number: 5,908,723

[45] Date of Patent: Jun. 1, 1999

[54] RECORDING SHEETS

[75] Inventors: Shadi L. Malhotra; Kirit N. Naik, both of Mississauga, Canada

[73] Assignee: Xerox Corporation, Stamford, Conn.

[21] Appl. No.: 08/852,550

[22] Filed: May 7, 1997

[51] Int. Cl.[6] ..... B41M 5/00

[52] U.S. Cl. ..... 430/31; 347/105; 428/195; 428/327; 428/500; 428/521; 428/522

[58] Field of Search ..... 347/105; 428/195, 428/323, 327–331, 500, 521, 522; 430/31

[56] References Cited

U.S. PATENT DOCUMENTS

| | | | |
|---|---|---|---|
| 3,154,461 | 10/1964 | Johnson | 161/116 |
| 3,515,626 | 6/1970 | Duffield | 161/162 |
| 3,790,435 | 2/1974 | Tanba et al. | 161/160 |
| 4,601,777 | 7/1986 | Hawkins et al. | 156/626 |
| 4,663,216 | 5/1987 | Toyoda et al. | 428/212 |
| 4,705,719 | 11/1987 | Yamanaka et al. | 428/323 |
| 5,075,153 | 12/1991 | Malhotra | 428/207 |
| 5,223,338 | 6/1993 | Malhotra | 428/342 |
| 5,314,747 | 5/1994 | Malhotra et al. | 428/341 |
| 5,320,902 | 6/1994 | Malhotra et al. | 428/342 |
| 5,422,175 | 6/1995 | Ito et al. | 428/304.4 |
| 5,441,795 | 8/1995 | Malhotra et al. | 428/195 |
| 5,457,486 | 10/1995 | Malhotra et al. | 347/105 |

*Primary Examiner*—Bruce H. Hess
*Attorney, Agent, or Firm*—E. O. Palazzo

[57] ABSTRACT

Disclosed are opaque plastic recording sheets comprised of (A) a substrate, (B) a receiving coating on the front side of the substrate capable of absorbing an ink vehicle and which receiving layer coating is comprised of (1) a hydrophobic binder polymer, (2) an ink wetting, (3) an ink spreading agent, (4) a dye mordant, (5) a lightfastness agent, (6) a filler, (7) an optional biocide; and (C) a toner receiving coating in contact with the reverse side of the substrate and which coating is comprised of (1) a binder polymer, (2) toner wetting and spreading agent, (3) an antistatic agent, (4) a pigment, (5) a lightfast agent, and (6) an optional biocide.

23 Claims, No Drawings

RECORDING SHEETS

COPENDING APPLICATIONS AND PATENTS

Illustrated in copending applications U.S. Ser. No. 852,553; U.S. Ser. No. 852,776; U.S. Ser. No. (not yet assigned—D/97025); and U.S. Pat. No. 5,846,637, the disclosures of which are totally incorporated herein by reference, are coated substrates and methods, coated ink jet papers, coated xerographic photographic papers, and decurling compositions, respectively.

U.S. Pat. No. 5,663,004, the disclosure of which is totally incorporated herein by reference, discloses a recording sheet which comprises a substrate, an image receiving coating, and a biocide.

BACKGROUND OF THE INVENTION

The present invention is directed to recording components, and more specifically, to never-tear opaque plastic recording sheets, that is, for example, opaque plastic recording sheets containing, for example, a plastic supporting substrate rather than a natural cellulose, with certain coatings thereover and thereunder, and the use of these recording sheets in ink jet printing processes, such as thermal ink jet processes, and xerographic imaging systems. Specifically, the present invention in embodiments is directed to opaque plastic recording sheets capable of, for example, accepting ink jet images on one side, preferably their front side, and xerographic images on the second, opposite, or reverse side of the substrate. More specifically, the present invention is directed to opaque plastic recording sheets wherein one side thereof, for example the front side, is coated with a first ink jet writeable composition capable of generating ink jet images of, for example, high optical density, such as between about 1.5 to about 2.0 for a black ink, between about 1.2 to about 1.6 for a cyan ink, between about 1.1 to about 1.4 for a magenta ink, and between about 1.0 to about 1.5 for a yellow ink, with lightfastness values of greater than about 95 percent, and more specifically, from about 95 to about 99.5 percent for all of the aforementioned inks, and related inks; waterfastness values greater than, or equal to about 90 percent, and more specifically, from about 90 to about 95 percent for all inks and low edge raggedness values of about 0.25 millimeter (between black and yellow), about 0.30 millimeter (between cyan and yellow), about 0.30 millimeter (between magenta and yellow), and about 0.45 millimeter (between magenta and cyan), and wherein the reverse side, opposite side, or back side of the substrate/sheet is coated with a second coating layer composition capable of accepting xerographic images of, for example, high optical density and with excellent lightfast values. The opaque plastic recording sheets can be prepared by coating an ink receiving layer on the front side of a plastic substrate and a xerographically compatible coating on the back side of the plastic substrate.

One embodiment of the present invention is directed to opaque plastic recording sheets comprised of (a) a substrate, such as polyvinylchloride, referred to as [vinyl], opaque MYLAR®, transparent MYLAR®, polypropylene, TESLIN® and the like; (1) a first ink receiving coating layer on the front side of the plastic substrate capable of absorbing the ink vehicle, and which coating is comprised of a water insoluble polymer, such as (acrylamidomethyl)cellulose acetate butyrate, acrylamidomethyl)cellulose acetate propionate, and the like, an ink spreading polymeric agent, such as a solvent swellable chlorodeoxycellulose, poly (styrene sulfonic acid-co-maleic acid), sodium salt, poly (acrylamide-co-diallyldimethyl ammonium chloride), starch-graft-(polyacrylic acid, sodium salt), and the like, an ink wetting agent such as pentaerythritol ethoxylate (3/4 EO/OH), pentaerythritol ethoxylate, (15/4 EO/OH) pentaerythritol propoxylate (5/4 PO/OH), pentaerythritol propoxylate (17/8 PO/OH), pentaerythritol propoxylate/ethoxylate, a cationic dye mordant such as quaternary compounds, polymethyl acrylate trimethyl ammonium chloride latex, 2-acryloyloxy ethyl (benzoyl benzyl) dimethylammonium bromide, o-xylylene-bis-(triphenyl) phosphonium bromide, heptyltriphenyl phosphonium bromide, dodecyl triphenyl phosphonium bromide, lightfastness UV absorbing compounds such as poly(4-hydroxy-2,2,6,6-tetramethyl-1-piperidine ethanol/dimethyl succinic acid), poly(3,5-di-tert-butyl-4-hydroxy hydrocinnamic acid ester/1,3,5-tris(2-hydroxyethyl)-5-triazine-2,4,6(1H,3H,5H)-trione, 1,2-hydro-4-(octyloxy) benzophenone, 2-(4-benzoyl-3-hydroxyphenoxy)ethyl acrylate and the like, lightfast antioxidant compounds such as didodecyl-3,3'-thiodipropionate, ditridecyl-3,3'-thiodipropionate, ditetra decyl-3,3'-thiodipropionate, dicetyl-3,3'-thiodipropionate, and lightfast antiozonant compounds such as N-(1,3-dimethylbutyl)-N'-phenyl-phenylenediamine, N,N'-di(2-otyl)-ρ-phenylene diamine, N,N'-bis(1,4-dimethyl pentyl)-ρ-phenylene diamine, and mixtures thereof, an optional biocide such as 2-hydroxypropylmethane thiosulfonate, a filler such as clay, calcium carbonate, colloidal silica; and (2) a second coating in contact with the back side of the plastic substrate capable of, for example, receiving xerographic images, and which second coating is comprised of (1) a water insoluble, solvent soluble, polymer such as polyacenaphthylene, poly(vinylphenylketone), poly (vinylphenylketone) hydrogenated, poly(vinyl acetate-co-butyl maleate-co-isobornyl acrylate), and the like, or mixtures thereof, a toner spreading agent such as tetraethylethylene tetracarboxylate, triethyl-1,3,5-benzene tricarboxylate, pentaerythritol tetrabenzoate, pentaerythritol-tetrakis(3,5-di-tert-butyl-4-hydroxy hydro cinnamate), and the like, an antistatic agent such as quaternary compounds of tetraoctyl phosphonium bromide, o-xylylene-bis-(triphenyl)phosphonium bromide), heptyltriphenyl phosphonium bromide), dodecyltriphenyl phosphonium bromide), an optional biocide such as 2-hydroxy propylmethane thiosulfonate, and a filler such as clay, calcium carbonate, silica, zirconium oxide, microspheres, and the like.

PRIOR ART

U.S. Pat. No. 3,154,461 discloses polymeric films with a matte-finish and a cellular structure achieved with the addition of fillers which roughens the surface upon stretching of the films and renders them receptive to marking by crayons, pencil and ball point pen.

U.S. Pat. No. 3,515,626 discloses laminates comprising layers of oriented films of thermoopaque plastic materials in which at least one of the outermost layers contains a suitable inert additive.

Disclosed in U.S. Pat. No. 3,790,435 are synthetic papers with acceptable foldability of a nonlaminated structure of one thermoopaque plastic resin film or a laminated structure of at least two thermoplastic resin films. The film is stretched or molecularly oriented, and one or more of the films contain a fine inorganic filler to provide paperness of the film. According to this patent, some of the films may contain certain amounts of poly(styrene) as a foldability improving agent.

There is disclosed in U.S. Pat. No. 4,663,216 a synthetic paper printable in high gloss, and comprised of (1) multilayer support, (2) a layer of a transparent film of a thermoplastic resin free from an inorganic fine powder formed on one surface of the support (1), and (3) an aqueous primer layer of a specific material, reference the Abstract of the Disclosure for example. The support (1) comprises (1a) a base layer of a biaxially stretched film of a thermoplastic resin, a surface and a back layer (1b), and (1c) composed of a monoaxially stretched film of a thermoplastic resin containing 8 to 65 percent by weight of an inorganic fine powder.

Further, there is disclosed in U.S. Pat. No. 4,705,719 a synthetic paper of multilayer resin film comprising a base layer (1a) of a biaxially stretched thermoplastic resin film, and a laminate provided on at least one of opposite surfaces of the base layer, the laminate including a paper-line layer (1b) and a surface layer (1c), the paper like layer containing a uniaxialiy stretched film of thermoplastic resin containing 8 to 65 percent by weight of inorganic fine powder, the surface layer containing an uniaxially stretched film of a thermoopaque plastic resin. Also known is an electrostatic recording material comprised of a multi-layered sheet support with an electroconductive layer and a dielectric layer formed thereon, reference for example U.S. Pat. No. 4,795,676.

Also, there is disclosed in U.S. Pat. No. 5,075,153 a never-tear paper comprised of an opaque plastic supporting substrate, a binder layer comprised of polymers selected from the group consisting of (1) hydroxy propyl cellulose, (2) poly(vinyl alkylether), (3) vinylpyrrolidone/vinylacetate, (4) quaternized vinyl pyrrolidone/dialkyl aminoethyl/methacrylate, (5) poly(vinylpyrrolidone), (6) poly (ethyleneimine), and mixtures thereof, and a pigment, or pigments, and an ink receiving polymer layer. One of the primary differences between the sheets of the present invention and the '153 patent is that with the invention sheets there is enabled because of the combination of components in each of the two layers excellent quality images with extended lifetimes.

Certain ink jet transparencies and papers for use in various printing and imaging processes are also known. Further, ink jet printing processes are described in, for example, U.S. Pat. No. 4,601,777, U.S. Pat. No. 4,251,824, U.S. Pat. No. 4,410,899, U.S. Pat. No. 4,412,224, and U.S. Pat. No. 4,532,530, the disclosures of each of which are totally incorporated herein by reference. U.S. Pat. No. 5,223,338 the disclosure of which is totally incorporated herein by reference, discloses a recording sheet which comprises a substrate and only one coating of, for example, quaternary ammonium polymers. Thus, with the sheets of the '338 patent there cannot be formed, it is believed, both ink jet images and dry toner images.

U.S. Pat. No. 5,314,747, the disclosure of which is totally incorporated herein by reference, discloses a recording sheet which comprises (a) a base sheet, (b) a cationic sulfur compound selected from the group consisting of sulfonium compounds, thiazolium compounds, benzothiazolium compounds, and mixtures thereof, (c) an optional binder, and (d) an optional pigment.

U.S. Pat. No. 5,441,795, the disclosure of which is totally incorporated herein by reference, discloses a recording sheet which comprises a base sheet and a material selected from the group consisting of pyridinium compounds, piperazinium compounds, and mixtures thereof.

U.S. Pat. No. 5,320,902, the disclosure of which is totally incorporated herein by reference, discloses a recording sheet which consists essentially a substrate and, in contact with the substrate, a monoammonium compound.

U.S. Pat. No. 5,422,175, the disclosure of which is totally incorporated herein by reference, discloses a void-containing composite film including (A) a polyester base layer containing voids comprised mainly of a polymer mixture of a polyester and a thermoplastic resin which is not compatible with the polyester resin, and which resin is selected from the group of polystyrene resins, polyolefin resins, polyacrylic resins, polycarbonate resins, polysulfone resins, cellulose resins, polysiloxane resins and silicone resins, and (B) at least one outer surface layer composed mainly of polyethylene terephthalate and formed on at least one side of the polyester base layer (A), at least one outer surface layer (B) being formed into a composite film by co-extrusion, followed by orientation in at least one direction, and wherein the void percentage of a surface portion with a 3 $\mu$m thickness from the surface of the polyester base layer (A) is 8 percent by volume or less, the average void percentage of the composite film being 10 percent to 50 percent by volume, and wherein the composite film contains substantially no voids at the interface between the polyester base layer (A) and the outer surface layer (B).

U.S. Pat. No. 5,457,486, the disclosure of which is totally incorporated herein by reference, discloses a recording sheet which comprises (a) a base sheet, (b) a material selected from the group consisting of tetrazolium compounds, indolinium compounds, imidazolinium compounds, and mixtures thereof, (c) an optional pigment, and (d) an optional binder.

While known opaque plastic papers and recording sheets may be suitable for their intended purposes, a need remains for improved opaque plastic recording sheets with improved waterfastness and lightfastness. There is also a need for coated opaque plastic recording sheets with improved traction to, for example, permit sheets that can be properly and continuously fed into various printers and copiers. Additionally, there is a need for opaque plastic recording sheets for ink jet printing with enhanced optical density, minimum showthrough, and less intercolor bleed. Further, there is a need for opaque plastic recording sheets for electrostatic printing processes, such as electrophotography, and which sheets exhibit excellent toner fix of the image to the sheets. Additionally, there is a need for opaque plastic recording sheets suitable for both ink jet printing processes and electrostatic printing processes which exhibit reduced curl and high optical density when used for ink jet printing, and which exhibit reduced curl and excellent toner fix when used for electrostatic printing. These and other needs are achievable in embodiments of the present invention.

SUMMARY OF THE INVENTION

It is an object of the present invention to provide opaque plastic recording sheets with many of the advantages illustrated herein.

It is another object of the present invention to provide improved opaque plastic recording sheets suitable for use in both ink jet printing processes and electrostatic printing processes wherein known dry toners comprised of, for example, thermoplastic resin, colorant, especially pigment, wax, surface additives, and the like are selected.

It is another object of the present invention to provide opaque plastic recording sheets with improved traction, thereby minimizing, or avoiding paper feeding problems.

It is yet another object of the present invention to provide improved coated opaque plastic recording sheets with reduced intercolor bleed between various colors.

It is still another object of the present invention to provide opaque plastic recording sheets for ink jet printing wherein the images resulting exhibit reduced curl and a high degree of light and waterfastness.

Another object of the present invention is to provide opaque plastic recording sheets for ink jet printing with enhanced optical density.

Still another object of the present invention is to provide opaque plastic recording sheets for electrostatic printing processes, such as electrophotography, which exhibit excellent toner fix of the image to the sheets.

It is another object of the present invention to provide opaque plastic recording sheets suitable for both ink jet printing processes and electrostatic printing processes, which exhibit images with high gloss, high optical density, improved lightfast and waterfastness when used for ink jet printing, and which exhibit reduced curl, acceptable toner fix, high gloss and minimum scratching and scuffing of the images when used for electrostatic printing. Thus, the sheets of the present invention can be selected for ink jet printing, dry toner development, or both.

Embodiments of the present invention relate to an opaque plastic recording sheet comprised of (A) a substrate, (B) a first ink receiving layer on the front side of the substrate capable of absorbing an ink vehicle, and which receiving layer coating is comprised of (1) a hydrophobic binder polymer, (2) an ink wetting agent, (3) an ink spreading agent, (4) a cationic dye mordant, (5) a lightfastness agent, (6) a filler, and (7) an optional biocide; and (C) a second toner receiving coating in contact with the reverse side of the substrate and which coating is comprised of (1) a binder polymer, (2) a toner wetting agent and a toner spreading agent, (3) an antistatic agent, (4) a colorant, such as a pigment, (5) a lightlastness inducing agent, and (6) an optional biocide.

In embodiments, the present invention relates to recording sheets comprised of a supporting substrate, such as polyvinylchioride (vinyl), opaque MYLAR®, transparent MYLAR®, polypropylene, TESLIN® and the like; (1) a first ink receiving layer, or coating on the front side of the supporting substrate, and which layer is, for example, capable of absorbing an ink vehicle from an ink jet ink composition, and which coating is comprised of a water insoluble hydrophobic polymer such as (acrylamidomethyl) cellulose acetate butyrate, (acrylamidomethyl)cellulose acetate propionate, and the like, an ink spreading polymeric agent such as a solvent swellable chlorodeoxycellulose, poly(styrene sulfonic acid-co-maleic acid), sodium salt, poly (acrylamide-co-diallyidimethyl ammonium chloride), poly (acrylic acid-co-acrylamide), potassium salt, starch-graft-(polyacrylic acid, sodium salt), and the like, an ink wetting agent such as pentaerythritol ethoxylate (3/4 EO/OH), pentaerythritol ethoxylate, (15/4 EO/OH) pentaerythritol propoxylate (5/4 PO/OH), pentaerythritol propoxylate (17/8 PO/OH), pentaerythritol propoxylate/ethoxylate, and the like, a cationic dye mordant such as quaternary compounds, polymethyl acrylate trimethyl ammonium chloride latex, 2-acryloyloxy ethyl(benzoyl benzyl)dimethylammonium bromide, o-xylylene-bis-(triphenyl)phosphonium bromide, heptyltriphenyl phosphonium bromide, dodecyl triphenyl phosphonium bromide, and the like, a lightfastness agent of, for example, UV absorbing compound, a lightfastness antioxidant, or an antioxidant, such as poly(4-hydroxy-2,2,6,6-tetramethyl-1-piperidine ethanol/dimethyl succinic acid), poly(3,5-di-tert-butyl-4-hydroxy hydrocinnamic acid ester/1,3,5-tris(2-hydroxy ethyl)-5-triazine-2,4,6-(1H,3H, 5H)-trione, 1,2-hydroxy-4-(octyloxy) benzophenone, 2-(4-benzoyl-3-hydroxyphenoxy)ethyl acrylate and the like, wherein the lightfast antioxidant compound is, for example, didodecyl-3,3'-thiodipropionate, ditridecyl-3,3'-thiodipropionate, ditetradecyl-3,3'-thiodipropionate, dicetyl-3,3'-thiodipropionate, and wherein the lightfast antiozonant compounds are, for example, N-(1,3-dimethylbutyl)-N'-phenyl-phenylenediamine, N,N'-di(2-otyl)-ρ-phenylenediamine, N,N'-bis(1,4-dimethyl pentyl)-ρ-phenylene diamine, and mixtures thereof; (in the lightfastness composition a UV absorbent may be selected in combination with an antioxidant, an antiozonant or both; when the UV absorbing compound is used in combination with the antioxidant or the antiozonant typically for every about 2 parts by weight of the UV absorbing compound, the antioxidant or the antiozonant is present in amounts of about 2 parts by weight; when the UV absorbing compound is used in combination with the antioxidant and an antiozonant, typically for every about 2 parts by weight of the UV absorbing compound, the antioxidant is selected in an amount of about 1 part by weight and the antiozonant is selected in an amount of about 1 part by weight); a biocide such as 2-hydroxypropylmethane thiosulfonate, and a filler such as clay, calcium carbonate, colloidal silica, and the like; and (2) a second coating, or layer in contact with the second side opposite to the above first side of the opaque plastic substrate, and capable of receiving xerographic images and comprised of (1) a water insoluble, solvent soluble, polymer such as polyacenaphthylene, poly(vinylphenylketone), poly (vinyl phenylketone) hydrogenated poly(vinyi acetate-co-butyl maleate-co-isobornyl acrylate), and the like, or mixtures thereof; (when a mixture of two binders is used one binder is present in amounts of, for example, from about 10 to 90 parts by weight and the second binder is present in amounts of, for example, from about 90 to 10 parts by weight); a toner wetting and toner spreading agent such as tetraethyl ethylene tetracarboxylate, triethyl-1,3,5-benzene tricarboxylate pentaerythritol tetrabenzoate, pentaerythritol-tetrakis(3,5-di-tert-butyl-4-hydroxy hydro cinnamate), and the like, an antistatic agent such as quaternary compounds of tetraoctyl phosphonium bromide, o-xylylene-bis(triphenyl) phosphonium bromide, heptyl triphenyl phosphonium bromide, dodecyltriphenyl phosphonium bromide, and the like, a lightfastness compound the same as or similar to the lightfastness compound for the first side, such as poly(4-hydroxy-2,2,6,6-tetramethyl-1-piperidine ethanol/dimethyl succinic acid), poly(3,5-di-tert-butyl-4-hydroxy hydrocinnamic acid ester/1,3,5-tris(2-hydroxyethyl)-5-triazine-2,4,6-(1H,3H ,5H)-trione, 1,2-hydroxy-4-(octyloxy) benzophenone, 2-(4-benzoyl-3-hydroxy phenoxy)ethyl acrylate and the like, and wherein the a lightfast antioxidant compound is, for example, didodecyl-3,3'-thiodipropionate, ditridecyl-3,3'-thiodipropionate, ditetradecyl-3,3'-thiodipropionate, dicetyl-3,3'-thiodipropionate, and wherein the lightfast antiozonant compound is, for example, N-(1,3-dimethylbutyl)-N'-phenylphenylenediamine, N,N'-di(2-otyl)-ρ-phenylene diamine, N,N'-bis(1,4-dimethyl pentyl)-ρ-phenylene diamine, and mixtures thereof; (in the lightfast composition a UV absorbent may be selected in combination with an antioxidant, an antiozonant or both; when the UV absorbing compound is selected in combination with the antioxidant or the antiozonant, typically for every about 2 parts by weight of the UV absorbing compound, the antioxidant or the antiozonant is present in amounts of about 2 parts by weight; when the UV absorbing compound is used in combination with the antioxidant and the antiozonant, typically for every 2 parts by weight of the UV absorbing compound, the antioxidant is present in an amount of about 1 part by weight and the antiozonant is present in an amount of about 1 part by weight); a biocide such as 2-hydroxy propylmethane thiosulfonate; a pigment, or filler, such as clay, calcium carbonate, silica, zirconium oxide, microspheres and the like, present, for example, in an amount of from about 1 part by weight to about 50 parts by weight and preferably from about 7 parts by weight to about 50 parts by weight.

The opaque plastic recording sheets of the present invention comprise a substrate or base sheet with a coating on both lateral surfaces thereof. Any suitable substrate can be employed. Examples of substrate materials include polyesters, including MYLAR®, polyethylene terephthalate available from E.I. DuPont de Nemours and Company, MELINEX®, polyethylene terephthalate available from Imperial Chemicals, Inc., CELANAR, polyethylene terephthalate available from Celanese Corporation, polyethylene naphthalates, such as Kaladex PEN films, available from Imperial Chemical Industries, polycarbonates, such as LEXAN® available from General Electric Company, polysulfones, such as those available from Union Carbide Corporation, polyether sulfones, like UDEL® available from Union Carbide Corporation, polyether sulfones, like VICTREX® available from ICI Americas Incorporated, poly(arylene sulfones), cellulose triacetate, polyvinylchloride, cellophane, polyvinyl fluoride, polyimides, and the like, with polyester, such as MYLAR®, being preferred primarily because of its availability and relatively low cost. The substrate can also be opaque, including opaque MYLARS®, examples of which are barium sulfate and titanium dioxide filled polyethylene terephthalate, void-containing polyesters of U.S. Pat. No. 5,422,175, the disclosure of which is totally incorporated herein by reference, opaque polyolefins, such as TESLIN®, which is considered a filled polypropylene with microvoids available from PPG Industries, and the like. Filled opaque plastics can also be selected as the substrate, particularly when it is desired to generate a "never-tear paper" recording sheet. Typically, the total thickness of the substrate is from about 50 to about 500 microns and preferably from about 75 to about 200 microns, although the thickness may be outside of these ranges.

The first layer coating/layer composition capable of receiving images from an ink jet printer with ink jets inks therein is present on the front, or first side of the substrate of the coated opaque plastic recording sheet of the present invention in any effective thickness. Typically, the total thickness of this coating layer is from about 0.1 to about 25 microns and preferably from about 5 to 20 microns, although the thickness may be outside of these ranges.

In the first coating composition, the binder can be present within the coating in any effective amount. For example, in a total of 100 parts by weight, the binder or mixtures thereof, such as (acrylamidomethyl)cellulose acetate butyrate, (acrylamidomethyl)cellulose acetate propionate, and the like, are present in amounts of, for example, from about 2 parts by weight to about 25 parts by weight; the ink spreading polymeric agent, such as solvent swellable chlorodeoxy cellulose, poly(acrylamide-co-diallyl dimethyl ammonium chloride), poly(acrylic acid-co-acrylamide) potassium salt, starch-graft-(polyacrylic acid sodium salt), and the like, is present in amounts of, for example, from about 3 parts by weight to about 20 parts by weight; the ink wetting agent is pentaerythritol ethoxylate (3/4 EO/OH), pentaerythritol ethoxylate (15/4 EO/OH), pentaerythritol propoxylate (5/4 PO/OH), pentaerythritol propoxylate (17/8 PO/OH), pentaerythritol propoxylate/ethoxylate is present, for example, in amounts of from about 45 parts by weight to about 1 part by weight; the dye mordant, such as quaternary compounds, poly(oxyethylene (dimethylamino)-ethylene (dimethylamino)ethylenedichicride), o-xylylene-bis-(triphenyl)phosphonium bromide, heptyltriphenyl phosphonium bromide, dodecyltriphenyl phosphonium bromide, is present, for example, in amounts of from about 33 parts by weight to about 2 parts by weight; the lightfastness, such as poly(4-hydroxy-2,2,6,6-tetramethyl-1-piperidine ethanol/dimethyl succinic acid), poly(3,5-di-tert-butyl-4-hydroxy hydrocinnamic acid ester/1,3,5-tris(2-hydroxyethyl)-5-triazine-2,4,6-(1H,3H,5H)-trione, 1,2-hydroxy-4-(octyloxy) benzophenone, 2-(4-benzoyl-3-hydroxy phenoxy) ethylacrylate and the like, is present, for example, in amounts of from about 0.5 to about 6 parts; the lightfast antioxidant compound, such as didodecyl-3,3'-thiodipropionate, ditridecyl-3,3'-thiodipropionate, ditetradecyl-3,3'-thiodipropionate, dicetyl-3,3'-thiodipropionate, and lightfast antiozonant compounds, such as N-(1,3-dimethylbutyl)-N'-phenyl-phenylene diamine, N,N'-di(2-octyl)-ρ-phenylene diamine, N,N'-bis(1,4-dimethyl pentyl)-ρ-phenylene diamine, are present in amounts of, for example, from about 1 to about 12 parts, or percent by weight; the biocide, such as 2-hydroxypropylmethane thiosulfonate, is present in amounts of, for example, from about 4 parts by weight to about 1 part by weight; the filler, such as clay, calcium carbonate, colloidal silica, is present in amounts of, for example, from about 1 part by weight to about 50 parts by weight; however, the amounts may be outside the ranges recited.

The aforementioned amounts can be determined, for example, as follows:

Various blends of the binder, the ink spreading agents, dye mordants, lightfast compounds, fillers, and the biocide are prepared in different solvents and coated on to various base sheets, such as MYLAR® and opaque MYLAR®, to yield coated substrate with a single layer thereover. After drying the base sheets at 100° C. (Centigrade), they were tested for coating adhesion to the base sheet, printed with a Xerox Corporation ink jet test fixture similar to the Xerox Corporation 4020 ink jet printer, to, for example, check print quality, drying times of the images, lightfast and intercolor bleed. The characteristics and data on image drying time, print quality, lightfastness, waterfastness, and the like, can be analyzed statistically to obtain the optimum components and amounts of each.

A preferred composition range for the first layer coating of the opaque plastic recording sheet is a binder present in amounts of from about 5 parts by weight to about 20 parts by weight, the ink spreading agent present in amounts of from about 5 parts by weight to about 20 parts by weight, the ink wetting agent present in an amount of from about 40 parts by weight to about 4 parts by weight, the dye mordant present in an amount of from about 30 parts by weight to about 3 parts by weight, the lightfastness compound or mixtures thereof present in amounts of from about 10 parts by weight to about 2 parts by weight, the filler present in amounts of from about 7 parts by weight to about 50 parts by weight, and the biocide compound present in amounts of from about 3 parts by weight to about 1 part by weight based on 100 parts (5+5+40+30+10+7+3) to (20+20+4+3+2+50+1).

Example of binder polymers for the first ink receiving layer present on the front side of the substrate in amounts of, for example, from about 2 parts by weight to about 25 parts by weight and preferably from about 5 parts by weight to about 20 parts by weight include solvent soluble polymers such as (1) poly(1-vinyl pyrrolidone)-graft-(hexadecene), Aldrich #43,050-1; (2) poly(1-vinylpyrrolidone)-graft-(1-triacontene), Aldrich #43,050-8; (3) polypropylene-graft-maleic anhydride, Aldrich #42,784-5; (4) polypropylene-graft-maleic anhydride chlorinated, Aldrich #42,733-0; (5) poly(ethylene-co-vinylacetate-co-methacrylic acid), Aldrich #43,654-7; (6) poly(ethylene-co-vinylacetate)-graft-maleic anhydride), Aldrich #42,652-0; (7) polyethylene-co-ethylacrylate-co-maleic anhydride), Aldrich #42,083-8; (8) poly(ethylene-co-methylacrylate-co-acrylic acid), Aldrich #43,268-7; (9) poly(ethylene-co-ethylacrylate-co-maleic anhydride), Aldrich #43,084-6; (10) poly(ethylene-co-butylacrylate-co-maleic anhydride), Aldrich #43,085-4; (11) poly(tert-butylacrylate-co-ethyl acrylate-co-methacrylic acid), Aldrich #44,479-0; (12) vinylalcohol-vinylbutyral copolymers #381; (13) vinylalcohol-vinylacetate copolymers #379; (14) vinylchloride-vinyl acetate copolymers #063, #068, #070, #422; (15) vinylchloride-vinylacetate-vinyl alcohol terpolymers #064, #427, #428, all being available from Scientific Polymer Products; (16) (acrylamidomethyl)cellulose acetate butyrate, #43,106-0, available from Aldrich Chemical Company; (17) (acrylamido methyl)cellulose acetate propionate, #43,107-9, available from Aldrich Chemical Company; (18) alkylene-maleic anhydride copolymers, wherein alkylene has at least one carbon atom and wherein the number of carbon atoms is such that the compound is water insoluble, preferably from 1 to about 20 carbon atoms, more preferably from 1 to about 10 carbon atoms, such as methylene, ethylene, propylene, butylene, and the like (such as ethylene-maleic anhydride copolymer #2308, available from Poly Sciences Inc., also available as EMA from Monsanto Chemical Company); (19) butadiene-maleic acid copolymers (such as #07787, available from Poly Sciences Inc.); and mixtures thereof.

The ink spreading agent of the first ink layer is present in amounts of, for example, from about 2 parts by weight to about 20 part by weight and preferably from about 5 parts by weight to about 20 parts by weight. Examples of ink spreading agents include polymeric compounds such as solvent swellable polymers like (1) dihydroxy alkyl cellulose, wherein alkyl has at least one carbon atom and wherein the number of carbon atoms is such that this component is water insoluble, preferably from 1 to about 20 carbon atoms, more preferably from 1 to about 10 carbon atoms, such as methyl, ethyl, propyl, butyl and the like, (such as dihydroxypropyl cellulose, which can be prepared by the reaction of 3-chloro-1,2-propane with alkali cellulose); (2) hydroxy alkyl hydroxy alkyl cellulose, wherein each alkyl has at least one carbon atom, and wherein the number of carbon atoms is such that this component is water insoluble, preferably from 1 to about 20 carbon atoms, more preferably from 1 to about 10 carbon atoms, such as methyl, ethyl, propyl, butyl and the like; (3) halodeoxycellulose, wherein halo represents a halogen atom (such as chlorodeoxycellulose, which can be prepared by the reaction of cellulose with sulfuryl chloride in pyridine at 25° C.); (4) amino deoxycellulose (which can be prepared by the reaction of chlorodeoxy cellulose with 19 percent alcoholic solution of ammonia for 6 hours at 160° C.); (5) carboxy-alkyl dextrans, wherein alkyl has at least one carbon atom and wherein the number of carbon atoms is such that the material is water insoluble, preferably from 1 to about 20 carbon atoms, more preferably from 1 to about 10 carbon atoms, such as methyl, ethyl, propyl, butyl, pentyl, hexyl, and the like (such as carboxymethyl dextrans, available from Poly Sciences Inc. as #16058); (6) dialkyl aminoalkyl dextran, wherein each alkyl has at least one carbon atom, and wherein the number of carbon atoms is such that the material, or this component is water insoluble, preferably from 1 to about 20 carbon atoms, more preferably from 1 to about 10 carbon atoms, such as methyl, ethyl, propyl, butyl and the like (such as diethyl aminoethyl dextran, available from Poly Sciences Inc. as #5178); (7) an n-carboxyalkyl chitin, wherein alkyl has at least one carbon atom, and wherein the number of carbon atoms is such that the material is water soluble, preferably from 1 to about 20 carbon atoms, more preferably from 1 to about 10 carbon atoms, such as methyl, ethyl, propyl, butyl and the like, such as n-carboxymethyl chitin; (8) dialkyl ammonium hydrolyzed collagen protein, wherein alkyl has at least one carbon atom, and wherein the number of carbon atoms is such that the material/compound (material, or compound throughout) is water soluble, preferably from 1 to about 20 carbon atoms, more preferably from 1 to about 10 carbon atoms, such as methyl, ethyl, propyl, butyl and the like (such as dimethyl ammonium hydrolyzed collagen protein, available from Croda as Croquats); (11) methyl-2-hydroxyethylcellulose, Aldrich #43,501-5; (12) 2-hydroxyethyl cellulose, hydrophobically modified, Aldrich #43,511-2; (13) poly (acrylamide-co-diallyl dimethyl ammonium chloride), Aldrich #40,908-1; (14) poly(acrylic acid-co-acrylamide), potassium salt, Aldrich #43,277-6; (15) starch-graft-(polyacrylic acid, sodium salt), Aldrich #41,441-7, Aldrich #41,102-2; (16) poly(styrene sulfonic acid-co-maleic acid), sodium salt, Aldrich #43,455-8; (17) poly(dimer acid-co-1,6-hexanediol-co-adipic acid), Aldrich #44,465-5; (18) poly (acrylic acid), sodium salt-graft-poly(ethylene oxide), Aldrich #43,278-4, (19) poly(anethole sulfonic aid, sodium salt), Aldrich #44,446-4; (20) poly(dimeracid-co-alkylpoly amine), Aldrich #19,103-5; and the like.

The ink wetting agents are present in an amounts of, for example, from about 45 parts by weight to about 1 part by weight and preferably from about 40 parts by weight to about 4 parts by weight, and examples thereof include (1) (hydroxy methyl)benzo guanamine methylated/ethylated, Aldrich #44,194-5; (2) pentaerythritol ethoxylate (3/4 EO/OIH), Aldrich #41,615-0; (3) pentaerythritol ethoxylate, (15/4 EO/OH), Aldrich #41,873-0; (4) pentaerythritol propoxylate (5/4 PO/OH), Aldrich #41,874-9; (5) pentaerythritol propoxylate (17/8 PO/OH), Aldrich #41,875-7; (6) pentaerythritol propoxylate/ethoxylate, Aldrich #42,502-8; (21) 2,2,3,3-tetrafluoro-1,4-butanediol, Aldrich #44,681-5; (7) 2,2,3,3,4,4,5,5,6,6,7,7,8,8,9,9,10,10,10-nonadecafluoro-1-decanol, Aldrich #44,683-1; (8) 2,2'-[4-(2-hydroxy ethyl amino)-3-nitrophenyl imino]diethanol, Aldrich #41,894-3; (9) 2,2,3,3,4,4-hexafluoro-1,5-pentanediol, Aldrich #H880-3; (9a) 2,5-dihydroxy-N-(2-hydroxyethyl) benzamide, Aldrich #36,599-8; (10) 2,4-dihydroxy-N-(2-hydroxyethyl) benzamide, Aldrich #23,281-5; (11) allylalcohol-1,2-butoxylate-block-ethoxylate, Aldrich #43,312-8, Aldrich #43,313-6; (12) allylalcohol-1,2-butoxylate-block-ethoxylate, ammonium sulfate, Aldrich #43,315-2, (13) allyl alcohol propoxylate, Aldrich #43,037-4; and the like.

The ink receiving layers can contain lightfastness agents including UV absorbing compounds, antioxidant compounds, antiozonant compounds, and mixtures thereof. The lightfastness agents are present in amounts of, for example, from about 12 parts by weight to about 1 part by weight and preferably from about 10 parts by weight to about 2 parts by weight of the total coating composition. When a mixture of lightfastness components is selected, and the mixture contains a UV absorber and an antioxidant, the UV compound is present, for example, in an amount of from about 8 to about 0.5 parts by weight, and the antioxidant is present in amounts of from about 4 to about 5 parts by weight. When three components of UV, antioxidant, and antiozonant are selected the UV compound is present in amounts of, for example, about 6 to about 0.5 part by weight; the antioxidant is present, for example, in an amount of from about 3 to about 0.25 part by weight; and the antiozonant compound is present, for example, in amounts of from about 3 to about 0.25 part by weight.

Examples of lightfastness agents are illustrated U.S. Ser. No. 656,814, the disclosure of which is totally incorporated herein by reference. The preferred lightfastness agents present, for example, in an amount of from about 6 to about 0.5 part by weight, include UV absorbing compounds such as poly[N,N-bis(2,2,6,6-tetramethyl-4-piperidinyl)-1,6-hexanediamine-co-2,4-dichloro-6-morpholino-1,3,5-triazine), available as Cyasorb UV-3346, #41,324-0, from Aldrich Chemical Company, poly(4-hydroxy-2,2,6,6-tetramethyl-1-piperidine ethanol/dimethyl succinic acid), available as Tinuvin 622LD from Ciba-Geigy Corporation, poly(3,5-di-tert-butyl-4-hydroxy hydrocinnamic acid ester/1,3,5-tris(2-hydroxyethyl)-5-triazine-2,4,6(1H, 3H, 5H)-trione, available as Good-rite 3125 from Goodrich Chemicals, 2-hydroxy-4-(octyloxy) benzophenone, available as Cyasorb UV-531, #41,315-1, from Aldrich Chemical Company 2-(4-benzoyl-3-hydroxy phenoxy)ethyl acrylate (Cyasorb UV-416, #41,321-6, available from Aldrich Chemical Company), and the like. Examples of lightfast antioxidant compounds include didodecyl 3,3'-thiodipropionate, available as Cyanox LTDP, #D12,840-6, from Aldrich Chemical Company; ditridecyl-3,3'-thiodipropionate, available as Cyanox 711, #41,311-9, from Aldrich Chemical Company; ditetradecyl-3,3'-thiodipropionate, available as Cyanox, MTDP, #41,312-7, from Aldrich Chemical Company; dicetyl-3,3'-thiodipropionate, available as Evanstab 16 from Evans Chemetics Corporation, and the like. Examples of antiozonant compounds present, for example, in amounts of from about 3 to about 0.25 part by weight, which is the same as or similar to the antioxidant, include N-(1,3-dimethylbutyl)-N'-phenyl-phenylenediamine, available as Santoflex 13 from Monsanto Chemicals, N,N'-di(2-octyl)-ρ-phenylene diamine, available as Antozite-1 from Vanderbilt Corporation, N,N'-bis(1,4-dimethyl pentyl)-ρ-phenylene diamine, available as Santoflex 77 from Monsanto Chemicals, and mixtures thereof.

Examples of suitable biocides, selected for each layer, and preferably the ink receiving layer are illustrated in copending application U.S. Ser. No. 196,605, the disclosure of which is totally incorporated herein by reference, and which biocides are present in, for example, amounts of from about 4 parts by weight to about 1 part by weight and preferably from about 3 parts by weight to about 1 part by weight. The preferred biocides include (A) nonionic biocides, such as (1) 2-hydroxypropylmethane thiosulfonate (Busan 1005 available from Buckman Laboratories Inc.); (2) 2-(thio cyanomethyl thio) benzothiazole (Busan 30WB, 72WB available from Buckman Laboratories Inc.); (3) methylene bis (thiocyanate) (Metasol T-10 available from Calgon Corporation, AMA-110 available from Vinings Chemical Company, Vichem MBT available from Vineland Chemical Company, Aldrich 10,509-0); (B) anionic biocides, such as (1) anionic potassium N-hydroxymethyl-N-methyl-dithiocarbamate (available as Busan 40 from Buckman Laboratories Inc.), (2) an anionic blend of N-hydroxymethyl-N-methyl dithiocarbamate (80 percent by weight) and sodium 2-mercapto benzothiazole (20 percent by weight) (available as Busan 52 from Buckman Laboratories Inc.); (C) cationic biocides, such as (1) cationic poly(oxyethylene (dimethylamino)-ethylene (dimethylamino) ethylene dichloride) (Busan 77 available from Buckman Laboratories Inc.); and (2) a cationic blend of methylene bisthiocyanate and dodecyl guanidine hydrochloride, available as SLIME TROL RX-31, RX-32, RX-32P, RX-33, from Betz Paper Chem Inc.

In addition, the ink receiving layer coating compositions of the present invention contain cationic dye mordants present in an amount of, for example, from about 33 to about 2 percent by weight and preferably from about 30 to about 3 percent by weight, and which dye mordants include o-xylylenebis(triphenyl)phosphonium bromide), Aldrich #X110-5, heptyltriphenylphosphonium bromide, Aldrich #37,753-8, dodecyl triphenyl phosphonium bromide, Aldrich #17,262-6, [3-(ethoxycarbonyl)-2-oxy propyl] triphenylphosphonium chloride, Aldrich #42,424-2, [3-(ethoxy carbonyl)-2-propyl]triphenylphosphonium bromide, Aldrich #34,985-2, benzyltriphenyl phosphonium bromide, Aldrich #43,005-6, (ethoxy carbonyl methyl) dimethyl phosphonium chloride, Aldrich #30,531-6, tetraoctylphosphonium bromide, Aldrich #44,213-5, (ethoxycarbonyl methyl) dimethyl sulfonium bromide, Aldrich #14,526-2, tetraethylammonium hexafluoro phosphate, Aldrich #43,411-6, tetrabutylammonium dihydrogen phosphate, Aldrich #4,710-2, tetramethylammonium hydrogen phthalate, Aldrich #43,832-4, (R)-(−)-3-pyrrolidinol hydrochloride, Aldrich #43,072-2, 1-propylpyridinium bromide, Aldrich #41,288-0, 2-propyl isoquinolinium bromide, Aldrich #41,287-2, 1-phenacylpyridinium bromide, Aldrich #15,142-4, 1,3-didecyl-2-methylimidazolium chloride, Aldrich #43,378-0, bis(tetra methyl ammonium)carbonate, Aldrich #43,838-3, bis(tetra butylammonium)sulfate, Aldrich #43,830-8, (2-acryloyloxy ethyl) (benzoyl benzyl)dimethylammonium bromide, Aldrich #40,632-5, (2-acryloyloxyethyl) trimethyl ammonium methyl sulfate, Aldrich #40,811-5; 2,5-dimethoxy-4-morpholino aniline dihydrochloride, Aldrich #43,936-3, 4-bromo piperidine hydrobromide, Aldrich #42,232-0, 3-amino-1H-isoindole hydrochloride, Aldrich #41,592-8, 2-amino-4'-methoxy acetophenone hydrochloride, Aldrich #41,594-4, (S)-(+)-2-amino-3-cyclohexyl-1-propanol hydrochloride, Aldrich #43,226-1, and 2-amino-4'-bromoacetophenone hydrochloride, Aldrich #41,534-0.

The ink receiving coating composition also contains fillers/pigments present in an amount of, for example, from about 1 part by weight to about 50 parts by weight and preferably from about 7 parts by weight to about 50 parts by weight. Examples of filler components are described in copending application U.S. Ser. No. 656,814, the disclosure of which is totally incorporated herein by reference. The preferred fillers include hollow microspheres including Eccospheres MC-37 (sodium borosilicate glass), Eccospheres FTD 202 (high silica glass, 95 percent $S10_2$), and Eccospheres SI (high silica glass, 98 percent $S10_2$), all available from Emerson and Cuming Inc., zirconium oxide (SF-EXTRA available from Z-Tech Corporation), colloidal silicas, such as SYLOID 74 available from Grace Company (preferably present, in one embodiment, in an amount of from about 10 to about 70 percent by weight percent), amorphous silica available as Flow-Gard CC 120, Flow-Gard CC 140, Flow-Gard CC 160, from PPG Industries, titanium dioxide (available as Rutile or Anatase from NL Chem Canada, Inc.), hydrated alumina (Hydrad TMC-HBF, Hydrad TM-HBC, available from J.M. Huber Corporation), barium sulfate (K.C. Blanc Fix HD80 available from Kali Chemie Corporation), calcium carbonate (Microwhite Sylacauga Calcium Products), high brightness clays (such as Engelhard Paper Clays), calcium silicate (available from J.M. Huber Corporation), cellulosic materials insoluble in water or organic solvents (such cellulosic materials being available from Scientific Polymer Products), blends of calcium fluoride and silica, such as Opalex-C available from Kemira O.Y., zinc oxide, such as Zoco Fax 183 available from Zo Chem, blends of zinc sulfide with barium sulfate, such as Lithopane available from Schteben Company, barium titanate, #20,810-8 available from Aldrich Chemicals, antimony oxide, #23,089-8 available from Aldrich Chemicals, as well as mixures thereof. Brightener fluorescent pigments of coumarin derivatives, such as Formula #633, available from Polymer Research Corporation of America, fluorescent pigments of oxazole derivatives, such as Formula #733 available from Polymer Research Corporation of America, can also be selected, and which fillers/pigments can enhance color mixing and assist in improving print-through in the opaque plastic papers of the present invention.

The second layer coating composition capable of receiving images from, for example, a xerographic copier is present on the opposite, or back side of the coated opaque plastic recording sheet of the present invention in any effective thickness. Typically, the total thickness of this coating layer is from about 0.1 to about 25 microns and preferably from about 2 to 20 microns, although the thickness may be outside of these ranges.

In the second coating composition, binder examples including polyacenaphthylene, poly(vinylphenylketone), poly(vinylphenylketone) hydrogenated, poly(vinyl acetate-co-butyl maleate-co-isobornylacrylate), are present from about 5 parts by weight to about 50 parts by weight, the toner wetting and spreading agents such as tetraethyl ethylenetetracarboxylate, triethyl-1,3,5-benzene tricarboxylate)pentaerythritol tetrabenzoate, pentaerythritol-tetrakis(3,5-di-tert-butyl-4-hydroxyhydrocinnamate), and which binder is present in amounts of, for example, from about 60 parts by weight to about 2 parts by weight. Examples of antistatic agents include quaternary compounds tetraoctylphosphonium bromide, o-xylylene-bis-(triphenyl) phosphonium bromide, heptyltriphenyl phosphonium bromide, dodecyltriphenyl phosphonium bromide, or mixtures thereof present in amounts of, for example, from about 15 parts by weight to about 1 part by weight. Lightfastness compounds present in the second coating include UV absorbing compounds such as poly(4-hydroxy-2,2,6,6-tetramethyl-1-piperidine ethanol/dimethyl succinic acid), poly(3,5-di-tert-butyl-4-hydroxy hydrocinnamic acid ester/1,3,5-tris(2-hydroxyethyl)-5-triazine-2,4,6-(1H,3H,5H)-trione, and 1,2-hydroxy-4-(octyloxy)benzophenone, 2-(4-benzoyl-3-hydroxy phenoxy) ethylacrylate. Lightfastness antioxidant compounds present in the second coating include didodecyl-3,3'-thiodipropionate, ditridecyl-3,3'-thiodipropionate, ditetradecyl-3,3'-thiodipropionate, dicetyl-3,3'-thio dipropionate, and the like. Examples of the lightfast antiozonant compounds present in the second coating include N-(1,3-dimethylbutyl)-N'-phenyl-phenylenediamine, N,N'-di(2-otyl)-ρ-phenylene diamine, N,N'-bis(1,4-dimethyl pentyl)-ρ-phenylene diamine, and mixtures thereof are present in amounts of, for example, from about 15 parts by weight to about 1 part by weight. Examples of fillers present in the second coating, such as microspheres, zirconium oxide, clays, calcium chloride and the like, are present in amounts of, for example, from about 1 part by weight to about 45 parts by weight, and the like. Examples of biocides include cationic blends of methylene bisthiocyanate and dodecyl guanidine hydrochloride, a cationic blend of bis(trichloromethyl) sulfone and a quaternary ammonium chloride, a cationic blend of methylene bis thiocyanate and chlorinated phenols present in amounts of, for example, from about 4 parts by weight to about 1 part by weight. The second coating layer and first coating layer may contain some of the same components and in the same amounts as indicated herein.

The aforementioned amounts can be determined, for example, as follows:

Various blends of the binder, the toner spreading agent, antistatic agent, lightfast agent, fillers, and the biocide were prepared in a solvent, such as toluene, and coated on to various base sheets, such as MYLAR®, to yield coated substrates with a single layer thereover. After drying the base sheets at 100° C., the resulting sheets were tested for coating adhesion to the base sheet, printed with a Xerox Corporation 5760 digital color copier to, for example, check print quality and lightfastness, and the optimum components and amounts of each determined statistically as indicated herein for the first layer.

A preferred range for the second layer coating of the opaque plastic paper is the binder present in amounts of from about 20 parts by weight to about 50 parts by weight, the toner wetting and toner spreading agent (this agent functions as both) present in an amount of from about 60 parts by weight to about 4 parts by weight, the antistatic agent present in an amount of from about 10 parts by weight to about 3 parts by weight, the lightfastness agent or mixtures thereof present in amounts of from about 6 parts by weight to about 2 parts by weight; the filler present in amounts of from about 1 part by weight to about 40 part by weight, and the biocide compounds or mixtures thereof present in amounts of from about 3 parts by weight to about 1 part by weight based on total of 100 parts (20+60+10+6+3+1) to (50+4+3+2+1).

The solvent soluble binder polymers of the second toner receiving layer are present on the backside of the substrate in an amount of, for example, from about 5 parts by weight to about 50 parts by weight and preferably from about 20 parts by weight to about 50 parts by weight, and include (1) polyacenaphthylene, Aldrich #18,125-0; (2) poly (vinylphenylketone), Aldrich #43,481-7; (3) poly(vinyl phenylketone)hydrogenated, Aldrich #43,482-5; (4) poly (vinylacetate-co-butyl maleate-co-isobornylacrylate); Aldrich #43,447-7; (5) polystyrene-block-poly(ethylene-random-butylene)-block-polystyrene-graft-maleic anhydride, Aldrich #43,243-1; (6) poly(propylene-co-1-hexene), Aldrich #42,824-8; (7) poly(2-methyl-1,3-propyleneglutarate) hydroxyterminated, Aldrich #43,102-8; (8) poly(4,4'-methylenebis-(phenylisocyanate)-alt-1,4-butanediol/polytetrahydrofuran, Aldrich #43,015-3; (9) poly [4,4'-methylenebis-(phenylisocyanate)-alt-1,4-butanediol/polybutyleneadipate], Aldrich #43,019-6; (10) poly[4,4'-methylenebis-(phenylisocyanate)-alt-1,4-butanediol/dipropylene glycol)/polycaprolactone, Aldrich #43,021-8; (11) poly[4,4'-methylene-bis-(phenylisocyanate)-alt-1,4-butanediol/polyethyleneglycol-co-propylene glycol)/polycaprolactone], Aldrich #43,022-6; (12) polylauryllactam-block-polytetrahydrofuran, Aldrich #43,080-3; (13) poly(4-hydroxybenzoic acid-co-6-hydroxy-2-naphthoic acid), Aldrich #43,234-2; (14) poly(ethylene-co-1-butene-co-1-hexene), Aldrich #43,475-2; (15) poly (ethylene-co-1-octene), Aldrich #43,041-2; (16) poly (ethylene-co-vinyl acetate-co-carbon monoxide), Aldrich

#43,061-7; (17) poly(ethylene-co-methyl acrylate), Aldrich #43,075-7; (18) poly(ethylene-co-methylacrylate-co-acrylic acid), Aldrich #43,268-7; (19) poly(ethylene-co-glycidylmethacrylate), Aldrich #43,364-0; (20) poly (ethylene-co-methylacrylate-co-glycidylmethacrylate), Aldrich #43,086-2; (21) poly(ethylene-2,6-naphthalene dicarboxylate), Aldrich #43,531-7; (22) poly(ethylene-co-carbon monoxide), Aldrich #42,835-3; (23) poly(ethylene-co-butylacrylate), Aldrich #42,078-1; (24) poly(ethylene-co-butylacrylate-co-carbon monoxide), Aldrich #43,066-8; (25) polycoumarone-co-indene, Aldrich #44,669-6; (26) poly(bisphenol A-co-4-nitrophthalic anhydride-co-1,3-phenylene diamine), Aldrich #43,229-6; (27) poly (bisphenol-A-co4,4'-(3,3,5-trimethyl cyclohexylidenediphenolcarbonate], Aldrich #43,058-7; (28) poly[1,4-benzene dicarbonyl-alt-bis(4-phenoxy phenyl methanone], Aldrich #42,728-4; (29) polybenzimidazole, Aldrich #30,979-6; (30) poly(1,4-butanediol) bis(4-amino benzoate), Aldrich #42,657-1; (31) poly(1,4-butyleneadipate-co-1,4-butylenesuccinate), Aldrich #44,800-1; (32) poly(1,4-cyclohexane-dimethylene terephthalate-co-ethyleneterephthalate), Aldrich #43,053-6; (33) poly(2-dihydro-2,2,4-trimethylquinolene), Aldrich #19,103-5; (34) vinylchloride-vinylidene chloride copolymers, #058; (35) vinylidene chloride-acrylonitrile copolymers, such as #395, #396, all being available from Scientific Polymer Products; (36) cyanoethylated cellulose, such as #091 available from Scientific Polymer Products; (37) cellulose acetate hydrogen phthalate, such as #085 available from Scientific Polymer Products; (38) hydroxypropylmethyl cellulose phthalate, such as HPMCP available from Shin-Etsu Chemical; (39) hydroxy propyl methyl cellulose succinate, such as HPMCS available from Shin-Etsu Chemical; (40) cellulose triacetate, such as #031 available from Scientific Polymer Products; (41) cellulose acetate butyrate, such as #077 available from Scientific Polymer Products; (42) cellulose propionate, such as #2052 available from Scientific Polymer Products, (43) cellulose acetate trimellitate, Aldrich #3,522-8; and mixtures thereof.

The toner wetting agents of the second toner receiving layer are present in amounts of from about 60 parts by weight to about 1 part by weight and preferably from about 60 parts by weight to about 4 parts by weight, and are comprised of, for example, (1) tetraethyl ethylenetetracarboxylate, Aldrich #16,539-5; (2) triethyl 1,3,5-benzene tricarboxylate, Aldrich #44,469-3; (3) pentaerythritol tetrabenzoate, Aldrich #36,937-3; (4) pentaerythritol tetrakis(3,5-di-tert-butyl-4-hydroxyhydrocinnamate), Aldrich #44,178-3; (5) (R)-4-[(1-methyl heptyloxy)carbonyl] phenyl 4'-octyloxy-4-biphenyl carboxylate, Aldrich #40,886-7; (6) (S)-4-[(1-methyl heptyloxy)carbonyl]phenyl-4'-octyloxy-4-biphenyl carboxylate, Aldrich #40,885-9; (7) methyl-2,5-dihydroxybenzoate, Aldrich #42,609-1; (8) methyl-2,6-dihydroxybenzoate, Aldrich #43,279-2; (9) methyl-3,5-dihydroxy benzoate, Aldrich #15,960-3; (10) methyl-10-bromodecanoate, Aldrich #44,745-5; (11) methyl-11-bromodecanoate, Aldrich #44,746-3; (12) 3-hydroxy-2,2-dimethylpropyl-3-hydroxy-2,2-dimethylpropionate, Aldrich #39,024-0; (13) N-[2-(2-oxo-1-imidazolidinyl)ethyl]methacrylamide, Aldrich #43,740-9; (14) N-[2-(2-oxo-1-imidazolidinyl)ethyl]methacrylate, Aldrich #42,498-6; (15) dihexyl azelate, Aldrich #44,788-9; (16) diglycidyl-1,2,3,6-tetrahydrophthalate, Aldrich #42,838-8; (17) diethyl-5-(hydroxymethyl) isophthalate, Aldrich #44,584-4; and (18) 2-tert-butyl-6-(5-chloro-2H-benzotrizol-2-yl)-4-methylphenol, Aldrich #42,247-9. The antistatic components of the second toner receiving layer are present in this layer in an amount of from about 15 parts by weight to about 2 parts by weight and preferably from about 10 parts by weight to about 3 parts by weight. These antistatic components can be anionic, or cationic. Examples of the cationic components of the second layer include quaternary salts, such as Cordex AT-172 and other materials available from Finetex Corporation, quaternary acrylic copolymer latexes; also suitable are monoammonium compounds as disclosed in, for example, U.S. Pat. No. 5,320,902, the disclosure of which is totally incorporated herein by reference, formaldehyde-free GARDOL DR/NF® available from Apollo Chemical Corporation, polyquaternary amine PERCHEM 553® available from Chem Link Industrial, polyquaternary amine, POLY PLUS 1290® available from Betz Paper Chem Inc., ARMOSOFT 420-90® available from Akzo Chemie Chemicals, MIRAPOL A-15 and MIRAPOL WT available from Miranol, Incorporated, Dayton, N.J., prepared as disclosed in U.S. Pat. No. 4,157,388, the disclosure of which is totally incorporated herein by reference, MIRAPOL AZ-1 available from Miranol, Incorporated, prepared as disclosed in U.S. Pat. No. 4,719,282, MIRAPOL AD-1 available from Miranol, Incorporated, prepared as disclosed in U.S. Pat. No. 4,157,388, MIRAPOL 9, MIRAPOL 95, and MIRAPOL 175, available from Miranol, Incorporated, Dayton, N.J., prepared as disclosed in U.S. Pat. No. 4,719,282, and the like, and mixtures thereof; diamino alkanes, quaternary salts, quaternary acrylic copolymer latexes HX-42-1, HX-42-3, available from Inter Polymer Corporation, ammonium quaternary salts as disclosed in U.S. Pat. No. 5,320,902, the disclosure of which is totally incorporated herein by reference, phosphonium quaternary salts as disclosed in copending application U.S. Ser. No. 08/034,917, the disclosure of which is totally incorporated herein by reference, and sulfonium, thiazolium and benzothiazolium quaternary salts as disclosed in U.S. Pat. No. 5,314,747, the disclosure of which is totally incorporated herein by reference.

Monoester sulfosuccinates, diester sulfosuccinates and sulfosuccinamates are examples of anionic antistatic components which have been found suitable for use in the second coating.

The lightfastness agents, fillers and biocides of the second toner receiving layer are selected from the same group of materials/compounds as illustrated herein for the first ink receiving layer.

The coating compositions of the present invention can be applied to the substrate by any suitable technique. For example, the layer coatings can be applied by a number of known techniques, including melt extrusion, reverse roll coating, solvent extrusion, and dip coating processes. In dip coating, a web of material to be coated is transported below the surface of the coating material (which generally is dissolved in a solvent) by a single roll in such a manner that the exposed site is saturated, followed by the removal of any excess coating by a blade, bar, or squeeze roll; the process is then repeated with the appropriate coating materials for application of the other layered coatings. With reverse roll coating, the premetered coating material (which generally is dissolved in a solvent) is transferred from a steel applicator roll onto the web material to be coated. The metering roll is stationary or is rotating slowly in the direction opposite to that of the applicator roll. In slot extrusion coating, a flat die is used to apply coating material (which generally is dissolved in a solvent) with the die lips in close proximity to the web of material to be coated. The die can have one or more slots if multilayers are to be applied simultaneously. In the multilayer slot coating, the coating solutions form a liquid stack in the gap where the liquids come in contact with the moving web to form a coating. The stability of the interface between the two layers depends on wet thickness, density and viscosity ratios of both layers which need to be kept as close to one as possible. Once the desired amount of coating has been applied to the web, the coating is dried, typically at from about 25 to about 100° C. in an air drier.

The edge raggedness values recited herein were measured using an Olympus microscope equipped with a camera capable of enlarging the recorded ink jet images. The edge raggedness value is the distance in millimeters for the intercolor bleed on a checkerboard pattern.

The opaque plastic recording sheets of the present invention in embodiments thereof exhibit reduced curl upon being printed with aqueous inks. Generally, the term "curl" refers to the distance between the base line of the arc formed by the recording sheet when viewed in cross-section across its width (or shorter dimension, for example 8.5 inches in an 8.5 by 11 inch sheet, as opposed to length, or longer dimension, for example 11 inches in an 8.5 by 11 inch sheet) and the midpoint of the arc. To measure curl, a sheet can be held with the thumb and forefinger in the middle of one of the long edges of the sheet (for example, in the middle of one of the 11 inch edges in an 8.5 by 11 inch sheet) and the arc formed by the sheet can be matched against a pre-drawn standard template curve.

The lightfast values of the ink jet images were measured in the Mark V Lightfast Tester obtained from Microscal Company, London, England.

The gloss values recited herein were obtained on a 75° gloss meter, Glossgard from Pacific Scientific (Gardner/Neotec Instrument Division). The edge raggedness values recited in the present application were measured using an Olympus microscope equipped with a camera capable of enlarging the recorded ink jet images. The edge raggedness value is the distance in millimeters for the intercolor bleed on a checkerboard pattern.

The optical density measurements recited herein were obtained on a Pacific Spectrograph Color System. The system is comprised of two major components, an optical sensor and a data terminal. The optical sensor employs a 6 inch integrating sphere to provide diffuse illumination and 2 degrees viewing. This sensor can be used to measure both transmission and reflectance samples. When reflectance samples are measured, a specular component may be included. A high resolution, full dispersion, grating monochromator was used to scan the spectrum from 380 to 720 nanometers. The data terminal features a 12 inch CRT display, numerical keyboard for selection of operating parameters, and the entry of tristimulus values, and an alphanumeric keyboard for entry of product standard information. The print through value as characterized by the printing industry is Log base 10 (reflectance of a single sheet of unprinted paper against a black background/reflectance of the back side of a black printed area against a black background) measured at a wavelength of 560 nanometers.

Embodiments of the present invention include a printing process, which comprises (a) providing the opaque plastic recording sheet illustrated herein; and incorporating it into an ink jet printing apparatus containing an aqueous ink; (b) causing droplets of the ink to be ejected in an imagewise pattern onto the ink receiving side of the recording sheet, thereby generating images on the recording sheet; and (c) thereafter exposing the recording sheet to heat thereby drying the recording liquid on the recording sheet; a printing process wherein the recorded images possess an optical density of between about 2.5 to about 2.65 for a black ink, between about 1.6 to about 1.65 for a cyan ink, between about 1.55 to about 1.57 for a magenta ink, between about 0.95 to about 1.0 for a yellow ink, with lightfast values of from about 96 to about 100 percent for all of said inks; waterfastness values of from about 93 to about 94.8 percent for all inks and low edge raggedness values of about 0.15 millimeter (between black and yellow), about 0.25 millimeter (between cyan and yellow), about 0.20 millimeter (between magenta and yellow), and about 0.30 millimeter (between magenta and cyan); a printing process which comprises (1) generating an electrostatic latent image on an imaging member in an imaging apparatus; (2) developing the latent image with a dry toner, which comprises a colorant, especially pigment and a resin, for example a thermoplastic resin selected from the group consisting of (A) polyesters, (B) styrene-butadiene copolymers, (C) styrene-acrylate copolymers, and (D) styrene-methacrylate copolymers; (3) transferring the developed image to the toner receiving side of the invention recording sheet; and (4) fixing the image onto the recording sheet with heat and pressure; a printing process wherein the recorded images have an optical density of between about 1.6 to 1.68 for a black toner, between about 1.3 to 1.35 for a cyan toner, between about 1.25 to 1.27 for a magenta toner, about 0.9 for a yellow toner, and with lightfast values of 100 percent for all of said toners, and waterfastness values of 100 percent for all of said toners; or a printing process wherein the recorded images have an optical density of between about 1.6 to 1.68 for a black toner, between about 1.3 to 1.35 for a cyan toner, between about 1.25 to 1.27 for a magenta toner, about 0.9 for a yellow toner, and with lightfast values of 100 percent for all of said toners, and waterfastness values of 100 percent for all of said toners.

Specific embodiments of the invention will now be described in detail. These Examples are intended to be illustrative, and the invention is not limited to the materials, conditions, or process parameters set forth in these embodiments. All parts and percentages are by weight unless otherwise indicated.

EXAMPLE I

Coated opaque plastic recording sheets were prepared by the solvent extrusion process (single side each time initially) on a Faustel Coater using a one slot die, by providing for each a transparent (this can be transparent, or opaque, and becomes opaque after being coated) MYLAR® base sheet (roll form) with a thickness of 100 microns and coating the base sheets with a composition comprised of 20.0 parts by weight of the binder (acrylamidomethyl)cellulose acetate butyrate, #43,106-0, available from Aldrich Chemical Company, 10.0 parts by weight of the ink spreading agent chlorodeoxycellulose, which was prepared by the reaction of cellulose with sulfuryl chloride in pyridine at 25° C., 5.0 parts by weight of the ink wetting agent (hydroxy methyl) benzo guanamine, methylated/ethylated, Aldrich #44,194-5, 15.0 parts by weight of the dye mordant cationic quaternary acrylic copolymer polymethyl acrylate trimethyl ammonium chloride latex, HX42-1, available from Interpolymer Corporation, 2.0 parts by weight of the UV absorber poly [N,N-bis(2,2,6,6-tetramethyl-4-piperidinyl)-1,6-hexanediamine-co-2,4-dichloro-6-morpholino-1,3,5-triazine) (Cyasorb UV-3346, #41,324-0, available from Aldrich Chemical Company), 2.0 parts by weight of the antioxidant didodecyl 3,3'-thiodipropionate, and 1.0 part by weight of the biocide 2-hydroxypropylmethane thiosulfonate (Busan 1005 available from Buckman Laboratories Inc.); and 45.0 parts by weight of the filler colloidal silica, Syloid 74 available from W.R. Grace and Company, which filler composition was present in a concentration of 10 percent by weight in acetone. Subsequent to air drying at 100° C. (Centigrade) and monitoring the difference in weight prior to and subsequent to coating, the dried MYLAR® rolls contained 1.0 gram, 11 microns in thickness, of the ink receiving layer with the above components. Rewinding the coated side of MYLAR® (roll form) on to an empty core, and using these rolls, the uncoated side of the MYLAR® base sheets were coated with a blend comprised of 20.0 parts by weight of poly(vinylacetate-co-butyl maleate-co-isobornyl acrylate), Aldrich #43,447-7, 25.0 parts by weight of the toner wetting agent tetraethyl ethylenetetracarboxylate, Aldrich #16,539-5, 2.0 parts by weight of poly[N,N-bis(2,2,6,6-tetramethyl-4-piperidinyl)-1,6-hexanediamine-co-2,4-dichloro-6-morpholino-1,3,5-triazine) (Cyasorb UV-3346, #41,324-0, available from Aldrich Chemical Company), 1.0 part by weight of the antioxidant didodecyl-3,3'-thiodipropionate, 1.0 part by weight of the antiozonant N,N'-di(2-octyl)-ρ-phenylene diamine, available as Annotate-1 from Vanderbilt Corporation, 1.0 part by weight of the biocide cationic poly(oxyethylene(dimethylamino)-ethylene (dimethylamino)ethylene dichloride) (Busan 77 available from Buckman Laboratories Inc.), 1.0 part by weight of the antistatic agent dodecyl triphenyl phosphonium bromide), Aldrich #17,262-6, and 49.0 parts by weight of colloidal silica, Syloid 74 available from W.R. Grace and Company, which filler composition was present in a concentration of 10 percent by weight in acetone. Subsequent to air drying at 100° C. and monitoring the difference in weight prior to and subsequent to coating, the dried MYLAR® base sheet rolls contained 1.0 gram, 11 microns in thickness of the pigmented traction controlling xerographic coating. The coated opaque plastic recording sheets were cut from this roll in 8.5 by 11.0 inch cut sheets.

These recording sheets were imaged on the ink receiving side with a Hewlett Packard heat assisted 1600C color Ink jet printer containing inks of the following compositions:

Cyan: 15.785 percent by weight of sulfolane, 10.0 percent by weight of butyl carbitol, 2.0 percent by weight of ammonium bromide, 2.0 percent by weight of N-cyclohexylpyrollidinone obtained from Aldrich Chemical Company, 0.5 percent by weight of tris (hydroxymethyl)aminomethane obtained from Aldrich Chemical Company, 0.35 percent by weight of EDTA (ethylenediamine tetra acetic acid) obtained from Aldrich Chemical Company, 0.05 percent by weight of DOWICIL 150 biocide obtained from Dow Chemical Company, Midland, Mich., 0.03 percent by weight of polyethylene oxide (molecular weight 18,500) obtained from Union Carbide Company), 35 percent by weight of Projet Cyan 1 dye obtained from ICI, and 34.285 percent by weight of deionized water.

Magenta: 15.785 percent by weight of sulfolane, 10.0 percent by weight of butyl carbitol, 2.0 percent by weight of ammonium bromide, 2.0 percent by weight of N-cyclohexylpyrollidinone obtained from Aldrich Chemical Company, 0.5 percent by weight of tris (hydroxymethyl)aminomethane obtained from Aldrich Chemical Company, 0.35 percent by weight of EDTA (ethylenediamine tetra acetic acid) obtained from Aldrich Chemical Company, 0.05 percent by weight of DOWICIL 150 biocide obtained from Dow Chemical Company, Midland, Mich., 0.03 percent by weight of polyethylene oxide (molecular weight 18,500) obtained from Union Carbide Company, 25 percent by weight of Projet magenta 1T dye obtained from ICI, 4.3 percent by weight of Acid Red 52 obtained from Tricon Colors, and 39.985 percent by weight of deionized water.

Yellow: 15.785 percent by weight of sulfolane, 10.0 percent by weight of butyl carbitol, 2.0 percent by weight of ammonium bromide, 2.0 percent by weight of N-cyclohexylpyrollidinone obtained from Aldrich Chemical Company, 0.5 percent by weight of tris (hydroxymethyl)aminomethane obtained from Aldrich Chemical Company, 0.35 percent by weight of EDTA (ethylenediamine tetra acetic acid) obtained from Aldrich Chemical Company, 0.05 percent by weight of DOWICIL 150 biocide obtained from Dow Chemical Company, Midland, Mich., 0.03 percent by weight of polyethylene oxide (molecular weight 18,500) obtained from Union Carbide Company, 27.0 percent by weight of Projet yellow 1G dye obtained from ICI, 20.0 percent by weight of Acid Yellow 17, obtained from Tricon Colors, and 22.285 percent by weight of deionized water.

The resulting images had a gloss value of 60, optical density values of 2.65 (black), 1.57 (magenta), 1.65 (cyan), 1.0 (yellow) before washing and 2.60 (black), 1.47 (magenta), 1.55 (cyan), 0.95 (yellow) after washing at 50° C. for two minutes, which translates into waterfastness values of 98 percent for the black ink, 92.7 percent for the (cyan) ink, 93.5 percent for the (magenta) ink, and 95 percent for the (yellow) ink. The optical density of these images after 72 hours in a Mark V Lightfastness Tester [equivalent to three months of 10 hour days of sunshine] were measured at 2.65 (black), 1.49 (magenta), 1.58 (cyan) and 1.0 (yellow), which translates into lightfastness values of 100 percent for the black ink, 94.5 percent for the (cyan) ink, 95 percent for the (magenta) ink, and 100 percent for the (yellow) ink. The high image quality obtained on these coated opaque plastic recording sheets was evidenced, for example, by their low edge raggedness values of 0.15 millimeter (between black and yellow), 0.25 millimeter (between cyan and yellow), 0.20 millimeter (between magenta and yellow), and 0.30 millimeter (between magenta and cyan). The edge raggedness values for an uncoated Xerox 4024 paper printed with the same inks were higher at 2.0 millimeters (between black and yellow), 0.95 millimeter (between cyan and yellow), 0.40 millimeter (between magenta and yellow), and 0.85 millimeter (between magenta and cyan).

These coated opaque plastic recording sheets were further utilized in a Xerox 5760 MajestiK™ Digital Color Copier carrying polyester resin based colored dry toners with cyan pigment blue 15.3, magenta, a blend of 40 weight percent of red 57.1 and 60 percent by weight of pigment red 122, yellow pigment 97, all the pigments being available from Sun Chemicals, and carbon black #25 available from Cabot Chemicals, and images were obtained on the toner receiving side of the coated opaque plastic papers. These images had a gloss of 80 units, and optical density values of 1.35 (cyan), 1.25 (magenta), 0.90 (yellow) and 1.64 (black). These images were 100 percent waterfast when washed with water for 2 minutes at 50° C., and 100 percent lightfast for a period of three months without any change in their optical density.

EXAMPLE II

Coated opaque plastic recording sheets were prepared by the solvent extrusion process (single side each time initially) on a Faustel Coater using a one slot die by providing for each an opaque MYLAR® sheet (roll form) with a thickness of 75 microns, and coating the base sheets with a composition comprised of 20.0 parts by weight of the binder (acrylamido methyl)cellulose acetate propionate, #43,107-9, 10.0 parts by weight of the ink spreading agent poly(styrene sulfonic acid-co-maleic acid), sodium salt, Aldrich # 43,455-8, 5.0 parts by weight of the ink wetting agent 2,2,3,3-tetrafluoro-1-butanediol, Aldrich #44,681-5, 15.0 parts by weight of the cationic dye mordant 2-acryloyloxy ethyl(benzoyl benzyl) dimethylammonium bromide, Aldrich #40,632-5, 2.0 parts by weight of the UV absorber poly[N,N-bis(2,2,6,6-tetramethyl-4-piperidinyl)-1,6-hexane diamine-co-2,4-dichloro-6-morpholino-1,3,5-triazine) (Cyasorb UV-3346, #41,324-0, available from Aldrich Chemical Company), 2.0 parts by weight of the antioxidant didodecyl-3,3'-thiodipropionate, 1.0 part by weight of the biocide-2-hydroxypropyl methane thiosulfonate (Busan 1005 available from Buckman Laboratories Inc.); and 45.0 parts by weight of the filler colloidal silica, Syloid 74 available from W.R. Grace and Company, which filler composition was present in a concentration of 10 percent by weight in acetone. Subsequent to air drying at 100° C. and monitoring the difference in weight prior to and subsequent to coating, the dried MYLAR® rolls contained 1.0 gram, 11 microns in thickness, of the ink receiving layer. Rewinding the coated side of MYLAR® (roll form) on to an empty core and using these rolls, the uncoated side of MYLAR® sheets was coated with a blend comprised of 40.0 parts by weight of polylauryl lactam-block-polytetrahydrofuran, Aldrich #43,080-3, 25.0 parts by weight of triethyl 1,3,5-benzene tricarboxylate, Aldrich #44,469-3, 2.0 parts by weight of poly[N,N-bis(2,2,6,6-tetramethyl-4-piperidinyl)-1,6-hexanediamine-co-2,4-dichloro-6-morpholino-1,3,5-triazine) (Cyasorb UV-3346, #41,324-0, available from Aldrich Chemical Company), 2.0 parts by weight of ditetradecyl-3,3'-thiodipropionate, 1.0 part by weight of the biocide cationic poly(oxyethylene(dimethylamino)-ethylene (dimethylamino)ethylene dichloride) (Busan 77 available from Buckman Laboratories Inc.), 1.0 part by weight of the antistatic agent tetraoctyl phosphonium bromide, Aldrich #44,213-5, and 29.0 parts by weight of calcium carbonate (Microwhite Sylacauga Calcium Products), which antistatic composition was present in a concentration of 10 percent by weight in dichloromethane. Subsequent to air drying at 100° C. and monitoring the difference in weight prior to and subsequent to coating, the dried opaque MYLAR® base sheet rolls contained 0.9 gram, 10 microns in thickness of the pigmented traction controlling xerographic coating. The coated opaque plastic recording sheets were cut from this roll in 8.5 by 11.0 inch cut sheets.

These recording sheets were imaged on the ink receiving side with a Hewlett Packard heat assisted 1600C color Ink jet printer containing ammonium bromide salt-free inks of the following compositions:

Cyan: 15.785 percent by weight of sullfolane, 12.0 percent by weight of butyl carbitol, 2.0 percent by weight of N-cyclohexylpyrollidinone obtained from Aldrich Chemical Company, 0.5 percent by weight of tris (hydroxymethyl)aminomethane obtained from Aldrich Chemical Company, 0.35 percent by weight of EDTA (ethylenediamine tetra acetic acid) obtained from Aldrich Chemical Company, 0.05 percent by weight of DOWICIL 150 biocide obtained from Dow Chemical Company, Midland, Mich., 0.03 percent by weight of polyethylene oxide (molecular weight 18,500) obtained from Union Carbide Company), 35 percent by weight of Projet Cyan 1 dye obtained from ICI, and 34.285 percent by weight of deicnized water.

Magenta: 15.785 percent by weight of sulfolane, 12.0 percent by weight of butyl carbitol, 2.0 percent by weight of N-cyclohexylpyrollidinone obtained from Aldrich Chemical Company, 0.5 percent by weight of tris(hydroxymethyl) aminomethane obtained from Aldrich Chemical Company, 0.35 percent by weight of EDTA (ethylenediamine tetra acetic acid) obtained from Aldrich Chemical Company, 0.05 percent by weight of DOWICIL 150 biocide, obtained from Dow Chemical Company, Midland, Mich., 0.03 percent by weight of polyethylene oxide (molecular weight 18,500) obtained from Union Carbide Company), 25 percent by weight of Projet magenta 1T dye obtained from ICI, 4.3 percent by weight of Acid Red 52 obtained from Tricon Colors, and 39.985 percent by weight of deionized water.

Yellow: 15.785 percent by weight of sulfolane, 12.0 percent by weight of butyl carbitol, 2.0 percent by weight of N-cyclohexylpyrollidinone obtained from Aldrich Chemical Company, 0.5 percent by weight of tris(hydroxy methyl)aminomethane obtained from Aldrich Chemical Company, 0.35 percent by weight of EDTA (ethylenediamine tetra acetic acid) obtained from Aldrich Chemical Company, 0.05 percent by weight of DOWICIL 150 biocide obtained from Dow Chemical Company, Midland, Mich., 0.03 percent by weight of polyethylene oxide (molecular weight 18,500), obtained from Union Carbide Company), 27.0 percent by weight of Projet yellow 1G dye obtained from ICI, 20.0 percent by weight of Acid Yellow 17 obtained from Tricon Colors, and 22.285 percent by weight of deionized water.

The resulting images possessed gloss value of 65, optical density values of 2.60 (black), 1.55 (magenta), 1.60 (cyan), 0.95 (yellow) before washing, and 2.55 (black), 1.47 (magenta), 1.50 (cyan), 0.90 (yellow) after washing at 50° C. for two minutes, which translates into waterfastness values of 98 percent for the (black) ink, 93.8 percent for the (cyan) ink, 94.8 percent for the (magenta) ink, and 94.5 percent for the (yellow) ink. The optical density of these images after 72 hours in a Mark V Lightfastness Tester [equivalent to three months of 10 hours per day of Sunshine] were measured at 2.60 (black), 1.49 (magenta), 1.58 (cyan) and 0.95 (yellow), which translates into lightfastness values of 100 percent for the (black) ink, 96.2 percent for the (cyan) ink, 96 percent for the (magenta) ink, and 100 percent for the (yellow) ink. The high image quality obtained on these coated opaque plastic recording sheets was evidenced by their low edge raggedness values of 0.14 millimeter (between black and yellow), 0.22 millimeter (between cyan and yellow), 0.21 millimeter (between magenta and yellow), and 0.32 millimeter (between magenta and cyan). The edge raggedness values for an uncoated Xerox 4024 paper printed with the same inks were higher at 2.0 millimeters (between black and yellow), 0.95 millimeter (between cyan and yellow), 0.40 millimeter (between magenta and yellow), and 0.85 millimeter (between magenta and cyan).

These coated opaque plastic papers were further utilized in a Xerox 5760 MajestiK™ Digital Color Copier carrying/transporting polyester resin based colored of Example II, and images were obtained on the toner receiving side of the coated opaque plastic papers. These images had a gloss of 75 units, and optical density values of 1.32 (cyan), 1.27 (magenta), 0.90 (yellow) and 1.68 (black). These images were waterfast when washed with water for 2 minutes at 50° C. and 100 percent lightfast for a period of three months without any change in their optical density.

Other embodiments and modifications of the present invention may occur to those skilled in the art subsequent to a review of the information presented herein; these embodiments and modifications, as well as equivalents thereof, are also included within the scope of this invention.

What is claimed is:

1. An opaque plastic recording sheet comprised of (A) a substrate, (B) a receiving layer on the front side of the substrate capable of absorbing an ink vehicle, and which receiving layer coating is comprised of (1) a hydrophobic binder polymer, (2) a polymeric ink wetting agent, (3) an ink spreading agent, (4) a cationic dye mordant, (5) a lightfastness agent, (6) a filler, and (7) an optional biocide; and (C) a toner receiving coating in contact with the reverse side of the substrate, and which coating is comprised of (1) a hydrophobic binder polymer, (2) a toner wetting agent and a toner spreading agent, (3) an antistatic agent, (4) a filler, (5) a lightfastness inducing agent, and (6) an optional biocide.

2. An opaque plastic recording sheet according to claim 1 wherein the substrate is selected from the group consisting of (1) polyesters, (2) polyethylene naphthalates, (3) polycarbonates, (4) polysulfones, (5) polyether sulfones, (6) poly(arylene sulfones), (7) cellulose triacetate, (8) polyvinylchloride, (9) cellophane, (10) polyvinyl fluoride, (11) polypropylene, (12) polyimides, and (13) opaque polyesters.

3. An opaque plastic recording sheet according to claim 1 wherein in the ink layer coating layer the binder is present in an amount of from about 5 parts by weight to about 20 parts by weight, the ink spreading agent is present in an amount of from about 5 parts by weight to about 20 parts by weight, the polymeric ink wetting agent is present in an amount of 40 parts by weight to about 4 parts by weight, the dye mordant is present in an amount of from about 30 parts by weight to about 3 parts by weight, the lightfastness agent is present in an amount of from about 10 parts by weight to about 2 parts by weight, the filler is present in an amount of from about 7 parts by weight to about 50 parts by weight, and the biocide is present in an amount of from about 3 parts by weight to about 1 part by weight.

4. An opaque plastic recording sheet according to claim 1 wherein the binder polymer of the ink receiving layer is present in an amount of from about 2 parts by weight to about 25 parts by weight, and which binder is selected from the group consisting of (1) poly(1-vinylpyrrolidone)-graft-(hexadecene), (2) poly(1-vinyl pyrrolidone)-graft-(1-triacontene), (3) ethylene-maleic anhydride copolymer, (4) butadiene-maleic acid copolymers, (5) polypropylene-graft-maleic anhydride, (6) polypropylene-graft-maleic anhydride chlorinated, (7) polyethylene-co-vinyl acetate)-graft-maleic anhydride), (8) polyethylene-co-ethylacrylate-co-maleic anhydride, (9) poly(ethylene-co-ethylacrylate-co-maleic anhydride), (10) poly(ethylene-co-butylacrylate-co-maleic anhydride), (11) poly(ethylene-co-methyl acrylate-co-acrylic acid), (12) poly(ethylene-co-vinylacetate-co-methacrylic acid), (13) poly(tert-butylacrylate-co-ethylacrylate-co-methacrylic acid), (14) vinyl alcohol-vinylbutyral-copolymers, (15) vinylalcohol-vinylacetate-copolymers, (16) (acrylamidomethyl)cellulose acetate butyrate, and (17) (acrylamidomethyl) cellulose acetate propionate.

5. An opaque plastic recording sheet according to claim 1 wherein the ink spreading wetting agent of the receiving layer is present in amounts of from about 3 parts by weight to about 20 parts by weight, and which polymer is selected from the group consisting of (1) dihydroxypropyl cellulose, (2) hydroxyethylhydroxypropyl cellulose, (3) chloro deoxycellulose, (4) amino deoxycellulose, (5) carboxymethyl dextrans, (6) diethyl aminoethyldextran, (7) n-carboxymethyl chitin, (8) dimethyl ammonium hydrolyzed collagen protein, (9) methyl-2-hydroxyethylcellulose, (10) 2-hydroxy ethyl cellulose hydrophobically modified, (11) poly(acrylamide-co-diallyl dimethyl ammonium chloride), (12) poly(acrylic acid-co-acrylamide)potassium salt, (13) starch-graft-(polyacrylic acid sodium salt), (14) poly(styrene sulfonic acid-co-maleic acid) sodium salt, (15) poly(dimer acid-co-1,6-hexanediol-co-adipic acid), (16) poly(acrylic acid) sodium salt-graft-poly(ethyleneoxide), (17) poly(anethole sulfonic acid sodium salt), and (18) poly(dimer acid-co-alkylpolyamine).

6. An opaque plastic recording sheet according to claim 1 wherein the ink polymeric wetting agent of the receiving layer is present in an amount of from about 45 parts by weight to about 1 part by weight, and which agent is (1) hydroxy methyl)benzoguanamine, methylated/ethylated, (2) allyl alcohol-1,2-butoxylate-block-ethoxylate, (3) allylalcohol-1,2-butoxylate-block-ethoxylate ammonium sulfate, (4) allyl alcohol propoxylate, (5) pentaerythritol ethoxylate (3/4 EO/OH), (6) pentaerythritol ethoxylate (15/4 EO/OH), (7) pentaerythritol propoxylate (5/4 PO/OH), (8) pentaerythritol propoxylate (17/8 PO/OH), (9) pentaerythritol propoxylate/ethoxylate, (10) 2,2,3,3-tetrafluoro-1,4-butanediol, (11) 2,2,3,3,4,4,5,5,6,6,7,7,8,8,9,9,10,10,10-nonadecafluoro-1-decanol, (12) 2,2'-[4-(2-hydroxyethylamino)-3-nitrophenyl imino]diethanol, (13) 2,2,3,3,4,4-hexafluoro-1,5-pentanediol, (14) 2,5-dihydroxy-N-(2-hydroxyethyl)benzamide, or (14) 2,4-dihydroxy-N-(2-hydroxyethyl)benzamide.

7. An opaque plastic recording sheet according to claim 1 wherein the cationic dye component of the receiving layer present in an amount of from about 33 to about 2 percent by weight is selected from the group consisting of (1) poly (oxyethylene(dimethylamino)-ethylene(dimethyl amino) ethylene dichloride), (2) o-xylylene-bis-(triphenyl) phosphonium bromide), (3) heptyltriphenyl phosphonium bromide), (4) dodecyltriphenyl phosphonium bromide, (5) [3-(ethoxycarbonyl)-2-oxypropyl]triphenyl phosphonium chloride, (6) [3-(ethoxycarbonyl)-2-propyl]triphenyl phosphonium bromide, (7) benzyl triphenyl phosphonium bromide, (8) (ethoxy carbonylmethyl)dimethyl phosphonium chloride, (9) dodecyl guanidine hydrochloride, (10) (ethoxy carbonyl methyl)dimethyl sulfonium bromide, (11) tetraoctyl phosphonium bromide, (12) tetraethyl ammonium hexafluoro phosphate, (13) tetrabutyl ammonium dihydrogen phosphate, (14) tetra methyl ammonium hydrogen phthalate, (15) (R)-(−)-3-pyrrolidinol hydrochloride, (16) 1-propylpyridinium bromide, (17) 2-propylisoquinolinium bromide, (18) 1-phenacylpyridinium bromide, (19) 1,3-didecyl-2-methylimidazolium chloride, (20) bis (tetramethylammonium)carbonate, (21) bis (tetrabutylammonium)sulfate, (22) (2-acryloyloxyethyl) (benzoylbenzyl) dimethyl ammonium bromide, (23) (2-acryloyloxyethyl)trimethyl ammonium methyl sulfate, (24) 2,5-dimethoxy-4-morpholino aniline dihydrochloride, (25) 4-bromo piperidinehydro bromide, (26) 3-amino-1H-isoindolehydrochloride, (27) 2-amino-4'-methoxyacetophenone hydrochloride, (28) (S)-(+)-2-amino-3-cyclohexyl-1-propanol hydrochloride, and (29) 2-amino-4'-bromo acetophenone hydrochloride.

8. An opaque plastic recording sheet according to claim 1 wherein the lightfastness agent is present in an amount of from about 12 parts by weight to about 1 part by weight, and is selected from the group consisting of UV absorbing compounds, antioxidant compounds, antiozonant compounds and mixtures thereof.

9. An opaque plastic recording sheet according to claim 1 wherein the filler component of the receiving layer coating is present in an amount of from about 1 part by weight to about 50 parts by weight, and is selected from the group consisting of (1) microspheres of sodium borosilicate glass, (2) microspheres of soda lime glass, (3) microspheres of phenolic polymers, (4) vinylidene chloride-acrylonitrile microspheres, (5) hollow composite microspheres of polyvinylidene chloride/acrylonitrile copolymer shell, 15 percent by weight, and calcium carbonate, 85 percent by weight, (6) stearate coated calcium carbonate, (7) sodium metasilicate anhydrous, (8) sodium metasilicate pentahydrate, (9) organophilic montmorillonitrile clay, (10) magnesium aluminum silicate, (11) magnesium carbonate, (12) magnesium oxide, (13) zirconium oxide, (14) colloidal silicas, (15) titanium dioxide, (16) hydrated alumina, (17) barium sulfate, (18) calcium carbonate, (19) high brightness clays, (20) calcium silicate, (21) blends of calcium fluoride and silica, (22) zinc oxide, (23) blends of zinc sulfide with barium sulfate, (24) barium titanate, (25) brightener fluorescent pigments of coumarin, (26) fluorescent pigments of oxazole, and (27) antimony oxide.

10. An opaque plastic recording sheet according to claim 1 wherein the total thickness of the coating layer is from about 0.1 to about 25 microns.

11. An opaque plastic recording sheet according to claim 1 wherein in the layer coating layer of the coated substrate the binder is present in amounts of from about 20 parts by weight to about 50 parts by weight, the toner wettingtoner spreading agent is present in an amount of from about 60 parts by weight to about 4 parts by weight, the antistatic agent is present in an amount of from about 10 parts by weight to about 3 parts by weight, the lightfastness inducing agent is present in amounts of from about 6 parts by weight to about 2 parts by weight, the filler is present in amounts of from about 1 part by weight to about 40 parts by weight, and the biocide compound is present in amounts of from about 3 parts by weight to about 1 part by weight.

12. An opaque plastic recording sheet according to claim 1 wherein said hydrophobic binder is present in amounts of from about 20 parts by weight to about 50 parts by weight, and which binder is selected from the group consisting of (1) polyacenaphthylene, (2) poly(vinylphenylketone), (3) poly (vinylphenylketone)hydrogenated, (4) poly(vinylacetate-co-butyl maleate-co-isobornylacrylate), (5) polystyrene-block-poly(ethylene-random-butylene)-block-polystyrene-graft-maleic anhydride, (6) poly(propylene-co-1-hexene), (7) poly (ethylene-co-butylacrylate), (8) poly(2-methyl-1,3-propylene glutarate)hydroxyterminated, (9) poly (10) poly [4,4'-methylenebis-(phenyl isocyanate)-alt-1,4-butanediol/polybutyleneadipate], (11) poly, (12) poly, (13) polylauryl lactam-block-polytetrahydrofuran, (14) poly(ethylene-co-1-butene-co-1-hexene), (15) poly(ethylene-co-1-octene), (16) poly(ethylene-co-vinylacetate-co-carbon monoxide), (17) poly(ethylene-co-methylacrylate), (18) poly(ethylene-co-glycidylmethacrylate), (19) poly(ethylene-co-methylacrylate-co-glycidyl methacrylate), (20) poly (ethylene-2,6-naphthalene dicarboxylate), (21) poly (ethylene-co-carbon monoxide), (22) poly(ethylene-co-butylacrylate-co-carbon monoxide), (23) poly(coumarone-co-indene), (24) poly, (25) poly, (26) poly, (27) polybenzimidazole, (28) poly(1,4-butanediol)bis(4-amino benzoate), (29) poly(1,4-butyleneadipate-co-1,4-butylenesuccinate), (30) poly(1,4-cyclohexane-dimethyleneterephthalate-co-ethyleneterephthalate), (31) poly(1,2-dihydro-2,2,4-trimethyl quinolene), (32) vinyl chloride-vinyl acetate copolymers, (33) vinylchloride-vinylacetate-vinylalcohol-terpolymers, (34) vinyl chloride-vinylidenechloride copolymers, (35) vinylidene chloride-acrylonitrile copolymers, (36) cyanoethylated cellulose, (37) cellulose acetate hydrogen phthalate, (38) hydroxypropyl methyl cellulose phthalate, (39) hydroxy propyl methyl cellulose succinate, (40) cellulose triacetate, (41) cellulose acetate butyrate, (42) cellulose propionate, and (43) cellulose acetate trimellitate.

13. An opaque plastic recording sheet according to claim 1 wherein the toner wetting/spreading agent of the toner layer are present in amounts of from about 60 parts by weight to about 2 part by weight, and which agents are (1) tetraethyl ethylene tetracarboxylate, (2) triethyl 1,3,5-benzene tricarboxylate, (3) pentaerythritol tetrabenzoate, (4) pentaerythritol-tetrakis(3,5-di-tert-butyl-4-hydroxy hydrocinnamate), (5) (R)-4-[(1-methylheptyloxy)carbonyl] phenyl-4'-octyloxy-4-biphenyl carboxylate, (6) (S)-4-[(1-methylheptyloxy)carbonyl]phenyl-4'-octyloxy-4-biphenylcarboxylate, (7) methyl-2,5-dihydroxybenzoate, (8) methyl-2,6-dihydroxybenzoate, (9) methyl-3,5-dihydroxybenzoate, (10) methyl-10-bromo decanoate, (11) methyl-11-bromodecanoate, (12) 3-hydroxy-2,2-dimethylpropyl-3-hydroxy-2,2-dimethylpropionate, (13) N-[2-(2-oxo-1-imidazolidinyl)ethyl]methacrylamide, (14) N-[2-(2-oxo-1-imidazolidinyl)ethyl] methacrylate, (15) dihexylazelate, (16) diglycidyl-1,2,3,6-tetrahydrophthalate, (17) diethyl-5-(hydroxymethyl)isophthalate, (18) 2-tert-butyl-6-(5-chloro-2H-benzotrizol-2-yl)-4-methylphenol, and mixtures thereof.

14. An opaque plastic recording sheet according to claim 1 wherein the thickness of the coating layer is from about 0.1 to about 25 microns.

15. An opaque plastic recording sheet according to claim 1 wherein the ink receiving coating on the front side of the substrate capable of absorbing an ink vehicle is comprised of (1) the hydrophobic binder polymers (acrylamidomethyl) cellulose acetate butyrate, and (acrylamido methyl)cellulose acetate propionate, (2) the ink wetting agent is (hydroxy methyl)benzo guanamine methylated/ethylated, or 2,2,3,3-tetrafluoro-1,4-butanediol, (3) ink spreading agent is chlorodeoxycellulose or (styrene sulfonic acid-co-maleic acid) sodium salt, (4) the cationic dye mordant is polymethyl acrylate trimethyl ammonium chloride latex, or 2-acryloyloxy ethyl(benzoyl benzyl) dimethylammonium bromide, (5) the lightfastness agent is poly[N,N-bis(2,2,6,6-tetramethyl-4-piperidinyl)-1,6-hexanediamine-co-2,4-dichloro-6-morpholino-1,3,5-triazine), or the antioxidant didodecyl-3,3'-thiodipropionate, or the antiozonant N,N'-di (2-octyl)-ρ-phenylene diamine, (6) the filler is colloidal silica, or calcium carbonate, and (7) the biocide is 2-hydroxypropylmethane thiosulfonate; and the toner receiving coating in contact with the reverse side of the substrate is comprised of (1) the binder polymer poly (vinylacetate-co-butyl maleate-co-isobornyl acrylate), or polylauryl lactam-block-polytetrahydrofuran, (2) the toner wetting and spreading agent of tetraethyl ethylene tetracarboxylate, or triethyl 1,3,5-benzene tricarboxylate, (3) the antistatic agent of tetraoctyl phosphonium bromide, or dodecyltriphenyl phosphonium bromide, (4) the filler of colloidal silica, or calcium carbonate, (5) the lightfast inducing agent of poly[N,N-bis(2,2,6,6-tetramethyl-4-piperidinyl)-1,6-hexanediamine-co-2,4-dichloro-6-morpholino-1,3,5-triazine), the antioxidant didodecyl-3,3'-thiodipropionate, the antiozonant N,N'-di(2-octyl)-ρ-phenylene diamine, or mixtures thereof, and (6) as a biocide cationic poly(oxyethylene(dimethylamino)-ethylene (dimethylamino)ethylene dichloride).

16. An opaque plastic recording sheet according to claim 15 wherein the ink receiving coating on the front side of the substrate has a thickness of from about 0.1 to about 25 microns, and is comprised of the hydrophobic binder polymer present in amounts of from about 2 parts by weight to about 25 parts by weight, the ink spreading agent is present in an amount of from about 3 parts by weight to about 20 parts by weight, the ink wetting agent is present in amounts of 45 parts by weight to about 1 part by weight, the cationic dye mordant is present in an amount of from about 33 parts by weight to about 2 parts by weight, the lightfastness agent is present in an amount of from about 12 parts by weight to about 1 parts by weight, the filler is present in amounts of from about 1 part by weight to about 50 parts by weight, and the biocide is present in amounts of from about 3 parts by weight to about 1 part by weight; and the toner receiving coating in contact with the reverse side of the substrate has a thickness of from about 0.1 to about 25 microns, and is comprised of a hydrophobic binder present in amounts of from about 5 parts by weight to about 50 parts by weight, a toner wetting/spreading agent present in an amount of from about 60 parts by weight to about 2 parts by weight, an antistatic agent present in an amount of from about 15 parts by weight to about 1 part by weight, a lightfastness inducing agent present in amounts of from about 15 parts by weight to about 1 parts by weight, a filler present in amounts of from about 1 part by weight to about 45 parts by weight, and a biocide present in amounts of from about 4 parts by weight to about 1 part by weight.

17. An opaque plastic recording sheet according to claim 15 wherein the ink receiving coating on the front side of the substrate has a thickness of from about 5 to about 20 microns, and is comprised of the hydrophobic binder polymer present in amounts of from about 5 parts by weight to about 20 parts by weight, the ink spreading agent is present in an amount of from about 5 parts by weight to about 20 parts by weight, the ink wetting agent is present in amounts of 40 parts by weight to about 4 parts by weight, the cationic dye mordant is present in an amount of from about 30 parts by weight to about 3 parts by weight, the lightfastness agent is present in amounts of from about 10 parts by weight to about 2 parts by weight, the filler is present in amounts of from about 7 parts by weight to about 50 parts by weight, and the biocide is present in amounts of from about 3 parts by weight to about 1 part by weight; and the toner receiving coating in contact with the reverse side of the substrate has a thickness of from about 2 to about 20 microns, and is comprised of a hydrophobic binder present in amounts of from about 20 parts by weight to about 50 parts by weight, a toner spreading agent present in an amount of from about 60 parts by weight to about 4 parts by weight, an antistatic agent present in an amount of from about 10 parts by weight to about 3 parts by weight, a lightfastness agent present in amounts of from about 6 parts by weight to about 2 parts by weight, a filler present in amounts of from about 1 part by weight to about 40 parts by weight, and a biocide present in amounts of from about 3 parts by weight to about 1 part by weight.

18. A printing process which comprises (a) providing the opaque plastic recording sheet of claim 15 and incorporating said sheet into an ink jet printing apparatus containing an aqueous ink; (b) causing droplets of the ink to be ejected in an imagewise pattern onto the ink receiving side of the recording sheet, thereby generating images on the recording sheet; and (c) thereafter exposing the recording sheet to heat thereby drying the recording liquid on the recording sheet.

19. A printing process which comprises (a) providing opaque plastic recording sheet of claim 1 and incorporating said sheet into an ink jet printing apparatus containing an aqueous ink; (b) causing droplets of the ink to be ejected in an imagewise pattern onto the ink receiving side of the recording sheet, thereby generating images on the recording sheet; and (c) thereafter exposing the recording sheet to heat thereby drying the recording liquid on the recording sheet.

20. A printing process in accordance with claim 19 wherein the recorded images possess an optical density of between about 2.5 to about 2.65 for a black ink, between about 1.6 to about 1.65 for a cyan ink, between about 1.55 to about 1.57 for a magenta ink, and between about 0.95 to about 1.0 for a yellow ink, with lightfastness values of from about 96 to about 100 percent for all of said inks; waterfastness values of from about 93 to about 94.8 percent for all inks and low edge raggedness values of about 0.15 millimeter (between black and yellow), about 0.25 millimeter (between cyan and yellow), about 0.20 millimeter (between magenta and yellow), and about 0.30 millimeter (between magenta and cyan).

21. A printing process which comprises (1) generating an electrostatic latent image on an imaging member in an imaging apparatus; (2) developing the latent image with a dry toner which comprises a colorant and a resin selected from the group consisting of (A) polyesters, (B) styrene-butadiene copolymers, (C) styrene-acrylate copolymers, and (D) styrene-methacrylate copolymers; (3) transferring the developed image to the toner receiving side of the recording sheet of claim 1; and (4) fixing the image onto the recording sheet with heat and pressure.

22. A printing process in accordance with claim 21 wherein the recorded images have an optical density of between about 1.6 to 1.68 for a black toner, between about 1.3 to 1.35 for a cyan toner, between about 1.25 to 1.27 for a magenta toner, about 0.9 for a yellow toner, and with lightfastness values of about 100 percent for all of said toners, and waterfastness values of about 100 percent for all of said toners.

23. A recording sheet comprised of (A) a substrate, (B) an ink receiving layer and which receiving layer is comprised of (1) a polymer, (2) a polymeric ink wetting agent, (3) an ink spreading agent, (4) a cationic dye mordant, (5) a lightfastness agent, (6) a filler, and (7) a biocide; and (C) a toner receiving coating and which coating is comprised of (1) a hydrophobic polymer, (2) a toner wetting/toner spreading agent, (3) an antistatic agent, (4) a filler, (5) a lightfastness inducing agent, and (6) a biocide.

* * * * *